US012312731B2

(12) United States Patent
Bhavsar et al.

(10) Patent No.: US 12,312,731 B2
(45) Date of Patent: May 27, 2025

(54) REMOVABLE AGITATOR WITH FABRIC SOFTENER DISPENSER

(71) Applicant: WHIRLPOOL CORPORATION, Benton Harbor, MI (US)

(72) Inventors: Anup Sudhir Bhavsar, Pune (IN); Eric W. Merrow, Benton Harbor, MI (US); Benjamin D. Lowell, Benton Harbor, MI (US); Bradley D. Morrow, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 244 days.

(21) Appl. No.: 17/844,556

(22) Filed: Jun. 20, 2022

(65) Prior Publication Data

US 2022/0316126 A1 Oct. 6, 2022

Related U.S. Application Data

(63) Continuation-in-part of application No. 17/010,422, filed on Sep. 2, 2020, now Pat. No. 11,932,979.

(60) Provisional application No. 62/895,331, filed on Sep. 3, 2019.

(51) Int. Cl.
*D06F 39/02* (2006.01)

(52) U.S. Cl.
CPC ..... *D06F 39/024* (2013.01)

(58) Field of Classification Search
CPC ..... D06F 13/00; D06F 13/02; D06F 13/04; D06F 13/06; D06F 13/08; D06F 21/06; D06F 21/08; D06F 23/04; D06F 37/12; D06F 37/14; D06F 37/145; D06F 37/40; D06F 39/024
See application file for complete search history.

(56) References Cited

U.S. PATENT DOCUMENTS

| | | | |
|---|---|---|---|
| 2,976,711 | A | 3/1961 | Smith |
| 4,118,957 | A | 10/1978 | Marcussen |
| D267,672 | S | 1/1983 | Ohmann et al. |
| D268,707 | S | 4/1983 | Ohmann et al. |
| D300,969 | S | 5/1989 | Bergeson |
| D314,263 | S | 1/1991 | Mueller |
| D326,937 | S | 6/1992 | Miyahara |
| 5,235,994 | A | 8/1993 | Comin et al. |

(Continued)

FOREIGN PATENT DOCUMENTS

| | | | |
|---|---|---|---|
| CN | 101191288 | A | 6/2008 |
| CN | 101600832 | A | 12/2009 |

(Continued)

*Primary Examiner* — David G Cormier
(74) *Attorney, Agent, or Firm* — BROOKS KUSHMAN P.C.

(57) ABSTRACT

An agitator is configured to be removably mounted to an impeller mount as a clothes mover. The agitator includes a post having a first end and an opposing second end. A connector is disposed at the first end of the post, the connector being configured to removably attach to a corresponding connector of the impeller mount. A dispenser cap assembly is configured to hold a dispenser cup and to control a lock from the second end of the post. The lock is configured to be adjusted between a locked position in which the agitator is secured to the impeller mount and an unlocked position allowing movement of the agitator with respect to the impeller mount.

20 Claims, 22 Drawing Sheets

(56) References Cited

U.S. PATENT DOCUMENTS

| | | | |
|---|---|---|---|
| D357,561 | S | 4/1995 | Kropf et al. |
| 5,500,967 | A | 3/1996 | Wilson et al. |
| D375,390 | S | 11/1996 | Pinkowski |
| D381,140 | S | 7/1997 | Pinkowski et al. |
| D423,740 | S | 4/2000 | Euler et al. |
| D424,874 | S | 5/2000 | Anton et al. |
| D426,108 | S | 6/2000 | Anton et al. |
| D474,567 | S | 5/2003 | Clark et al. |
| D474,568 | S | 5/2003 | Clark et al. |
| D477,697 | S | 7/2003 | Bullock et al. |
| D485,654 | S | 1/2004 | Clark et al. |
| 7,069,752 | B2 | 7/2006 | Clark et al. |
| D687,202 | S | 7/2013 | Motsenbocker |
| D749,137 | S | 2/2016 | Mosich et al. |
| D762,028 | S | 7/2016 | Rodrigues et al. |
| D764,730 | S | 8/2016 | Chaklos |
| 10,731,284 | B2 | 8/2020 | Alexander et al. |
| 10,787,761 | B2 | 9/2020 | Czarnecki et al. |
| D933,916 | S | 10/2021 | Bae et al. |
| D933,917 | S | 10/2021 | Bae et al. |
| D933,918 | S | 10/2021 | Kim et al. |
| D933,919 | S | 10/2021 | Kim et al. |
| D942,701 | S | 2/2022 | Geissler et al. |
| D957,077 | S | 7/2022 | Bae et al. |
| D957,078 | S | 7/2022 | Bae et al. |
| D967,576 | S | 10/2022 | Kim et al. |
| D968,734 | S | 11/2022 | Kim et al. |
| 2012/0085133 | A1 | 4/2012 | Slutsky et al. |
| 2018/0155864 | A1 | 6/2018 | Alexander et al. |
| 2019/0017208 | A1 | 1/2019 | Marangoni et al. |
| 2021/0062382 | A1 | 3/2021 | Andrejczuk et al. |
| 2022/0243379 | A1 | 8/2022 | Adkins et al. |
| 2022/0325462 | A1* | 10/2022 | Seereddy ..... D06F 37/40 |

FOREIGN PATENT DOCUMENTS

| | | | |
|---|---|---|---|
| CN | 203530690 | U | 4/2014 |
| CN | 203729101 | U | 7/2014 |
| KR | 19980031291 | U | 8/1998 |
| KR | 100556483 | B | 3/2006 |
| WO | 2015048870 | A1 | 4/2015 |

* cited by examiner

REMOVABLE AGITATOR WITH FABRIC SOFTENER DISPENSER

CROSS-REFERENCE TO RELATED APPLICATIONS

This application is a continuation-in-part of U.S. patent application Ser. No. 17/010,422 filed Sep. 2, 2020, now issued as U.S. Pat. No. 11,932,979 on Mar. 19, 2024, which in turn claims the benefit of U.S. provisional application Ser. No. 62/895,331 filed Sep. 3, 2019, the disclosures of which are hereby incorporated in their entireties by reference herein.

TECHNICAL FIELD

Aspects of the disclosure generally relate to removable agitators for laundry treating appliances, and in particular to removable agitators having built-in dispensing capabilities.

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. The controller can further control a motor to rotate the laundry basket or drum according to one of the pre-programmed cycles of operation. The controller can also control a clothes mover provided within the laundry basket or drum and configured to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

Filters are used in laundry treating appliances to capture pet hair, lint, and other particulates from laundry loads. The captured particulate is retained inside the filter, allowing the consumer to clean the filter after a wash cycle is completed. For customers who do not use clothes drying appliances, it is especially important to trap lint during the wash cycle.

SUMMARY

In one or more illustrative examples, an agitator is configured to be removably mounted to an impeller mount as a clothes mover. The agitator includes a post having a first end and an opposing second end. A connector is disposed at the first end of the post, the connector being configured to removably attach to a corresponding connector of the impeller mount. A dispenser cap assembly is configured to hold a dispenser cup and to control a lock from the second end of the post. The lock is configured to be adjusted between a locked position in which the agitator is secured to the impeller mount and an unlocked position allowing movement of the agitator with respect to the impeller mount.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Aspects of the disclosure generally relate to a 2-in-1 removable agitator that implements an integrated fabric softener dispenser. In one example, the removable agitator utilizes a rotatable dispenser cap to facilitate locking and unlocking of the removable agitator from an impeller base. In another example, the dispenser cap may be pulled against a biasing mechanism to lock and unlock the agitator barrel from the impeller base. Further aspects of the disclosure are discussed in detail herein.

Figure 1:
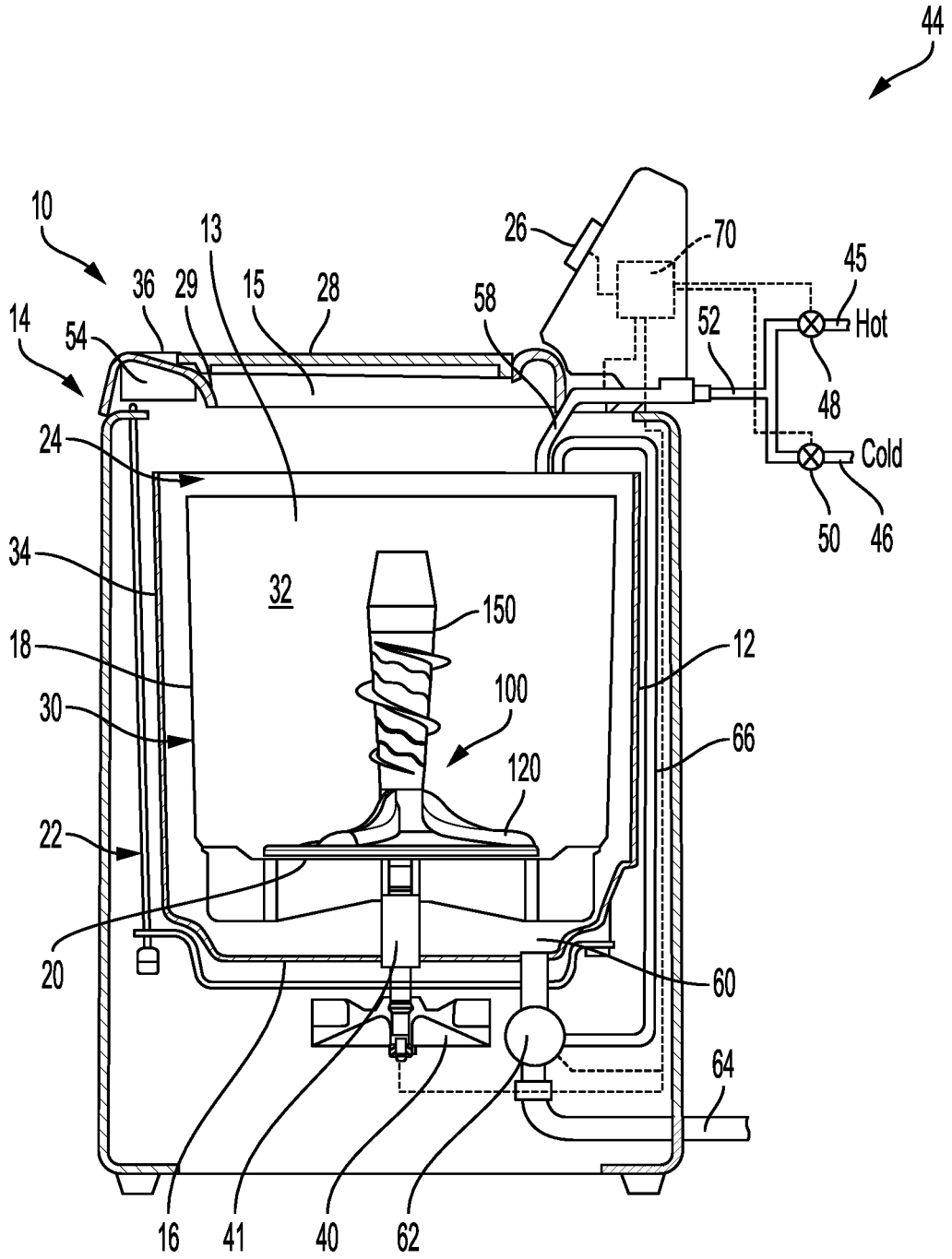
FIG. 1 is a simplified cross-sectional view of a laundry treating appliance including a removable filtering agitator.

FIG. 1 is a simplified view of a laundry treating appliance 10 including a removable filtering agitator 150. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A clothes mover 100 can be rotatably mounted within the basket 30 to impart mechanical agitation and energy to a load of laundry items placed in the basket 30 or the treating chamber 32 according to a cycle of operation. The clothes mover 100 can be oscillated or rotated about its vertical axis of rotation during a cycle of operation in order to produce load motion effective to wash the load contained within the treating chamber 32. The clothes mover 100 can comprise a base or a first clothes mover, illustrated herein as an impeller 120, and a barrel, illustrated herein as an agitator 150. The agitator 150 as illustrated herein can comprise a vertically oriented agitator post that can be removably coupled with the impeller 120, the agitator 150 projecting vertically from the impeller 120 within the treating chamber 32 and toward the open top 13 of the basket 30. In this aspect of the disclosure, the clothes mover 100 can be formed by coupling an additional component, the agitator 150, to the impeller 120 and can be thought of as forming a second clothes mover.

The agitator 150 can include any configuration of vanes, blades, or other structural features for imparting mechanical energy to laundry items during a cycle of operation. Generally, the vertical extent of the agitator 150, combined with vane, blade, or other structural features, can impart the mechanical action to laundry items, which provides improved cleaning performance and can be suitable for particularly soiled loads. Other exemplary types of clothes movers include, but are not limited to, an agitator alone, a wobble plate, and a hybrid impeller/agitator.

The basket 30 and the clothes mover 100 can be driven, such as to rotate within the tub 34, by a drive assembly 40 that includes a motor 41, which can include a gear case, operably coupled with the basket 30 and clothes mover 100. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the clothes mover 100.

A suspension assembly 22 can dynamically hold the tub 34 within the cabinet 14. The suspension assembly 22 can dissipate a determined degree of vibratory energy generated by the rotation of the basket 30 and/or the clothes mover 100 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e., a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e., a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2B:
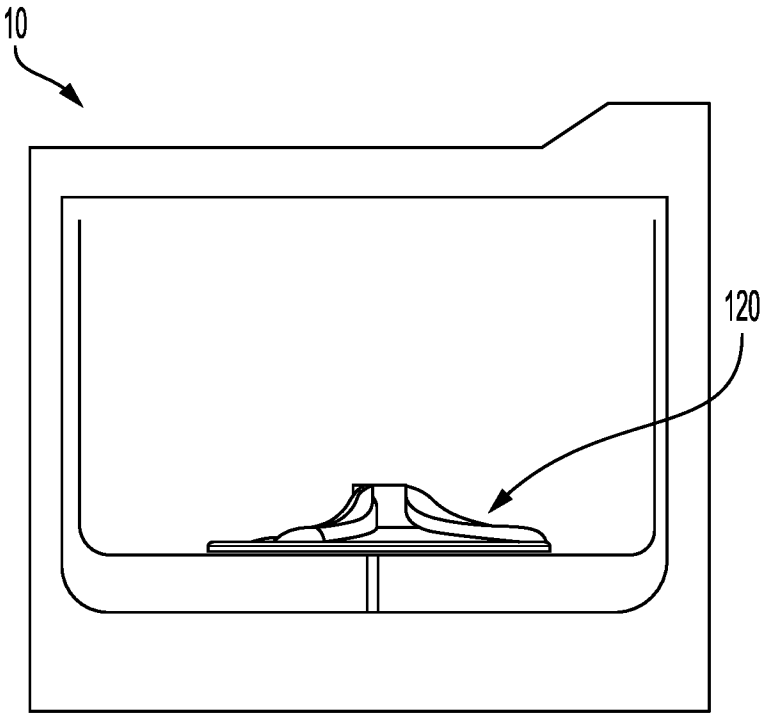
FIG. 2B is a simplified cross-sectional view of the laundry treating appliance and the clothes mover of FIG. 1 with the agitator shown in a detached configuration.
Figure 2A:
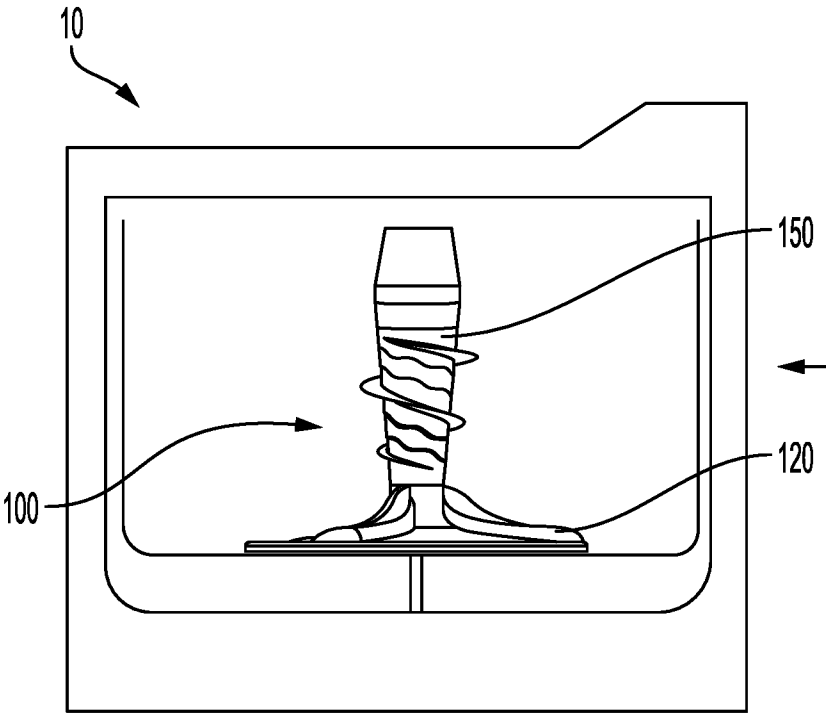
FIG. 2A is a simplified cross-sectional view of the laundry treating appliance and the clothes mover of FIG. 1 with the agitator shown in an attached configuration.

Referring now to FIG. 2, the laundry treating appliance 10 as described herein allows the user to customize the laundry treating appliance 10 for treating the laundry load or loads to be treated. For example, the laundry treating appliance 10 can be utilized and operated with one of at least two different configurations, each utilizing a different type of clothes mover 100, the configurations selectable based on the user's treatment needs. Aspects of the laundry treating appliance 10 described herein allow the user to selectively assemble and disassemble the agitator 150, which can be thought of as forming a second clothes mover, and the impeller 120, which can be thought of as a first clothes mover, to configure the laundry treating appliance 10 into one of the two configurations. The user can customize the clothes mover 100 based on the user's personal preferences, based on the amount and/or type of mechanical action implemented by the different configurations of the clothes mover 100, and/or based on characteristics of the laundry items to be treated, non-limiting examples of which include an amount of laundry items to be treated, a size of the laundry item(s) to be treated, soil level of the laundry items, an amount and/or type of mechanical energy to be applied to the laundry items, the type of fabric of the laundry items (e.g., whether the laundry is delicate or rugged), and a fill level of liquid during treatment.

The laundry treating appliance 10 can be configured in a first configuration, illustrated by way of example as a configuration A as shown, and also as illustrated in FIG. 1, by assembling the agitator 150 with the impeller 120 within the laundry treating appliance 10. In the configuration A, the user can elect to use the clothes mover 100 that includes the agitator 150 for treating a laundry load. Such a configuration as configuration A can be useful if the user wishes to implement a treatment mode using agitator-based washing, such as for imparting significant or high quantities of mechanical action onto particularly soiled laundry items, or if the user wishes to perform deep water washing, or based on any other user preference for the clothes mover 100 and the agitator 150, such as a personal preference.

In another example, the laundry treating appliance 10 can also be configured in a second configuration, illustrated by way of example as a configuration B as shown, by assembling only the impeller 120 within the laundry treating appliance 10 and decoupling or removing the agitator 150. In the configuration B, the user elects to use the clothes mover 100 with the lower profile impeller 120 and that does not include the agitator 150 or any similar agitator post. Such a configuration as configuration B can be useful if the user wishes to implement a treatment mode using impeller-based washing, such as for low water washing, for gentler washing, wherein a lower mechanical action is imparted to the laundry items, or for washing bulky items such as blankets or comforters that could tangle around the agitator 150. Larger, bulky laundry items generally do not fit well in the basket 30 when a vertical-oriented agitator-type clothes mover 100, such as configuration A including the agitator 150, is present. Thus, the user can selectively configure the laundry treating appliance 10 to utilize the only the impeller 120 as illustrated in the configuration B, without the agitator 150 extending upward into the treating chamber 32, for use in treating large and/or bulky loads or to implement a low water treatment mode, for example, or based on another preference of the user, such as a personal preference.

The components of the laundry treating appliance 10 are configured to allow the user to configure and re-configure the laundry treating appliance 10 into either of the agitator 150 configuration A and the impeller 120 configuration B as desired. The user can select either of the configurations A or B based on personal preference of utilizing the particular type of clothes mover 100 of configuration A or B over the other, the desired cycle of operation to be implemented, and/or characteristics of the laundry items or the laundry load.

Turning now to the process or method of configuring or re-configuring the clothes mover 100, to operate the laundry treating appliance 10 and to utilize configuration A in which the agitator 150 is present in the laundry treating appliance 10, the user can assemble the agitator 150 in the laundry treating appliance 10, such as by coupling or assembling the agitator 150 to the impeller 120 to form the clothes mover 100. The user can then utilize the laundry treating appliance 10 to implement a cycle of operation on a load of laundry in a conventional manner. When the agitator 150 is configured to be supported at least in part by the impeller 120, configuration A will include the impeller 120. Optionally, if the agitator 150 does not require the impeller 120 for support, such as when the agitator 150 can be supported by the basket 30, configuration A does not have to include the impeller 120. In this alternative configuration A, the impeller 120 does not have to be present and the clothes mover 100 can be utilized with just the agitator 150.

To operate the laundry treating appliance 10 and to utilize configuration B in which only the impeller 120 is present in the laundry treating appliance 10, the removable agitator 150 is disassembled or uncoupled from the impeller 120 by the user and removed from the laundry treating appliance 10, and the impeller 120 is assembled within the basket 30. To assemble the impeller 120 within the basket 30, the agitator 150 can be configured to separate from the impeller 120 while the impeller 120 remains coupled with the drive assembly 40 and the motor 41. The user can then utilize the laundry treating appliance 10 to implement a cycle of operation on a load of laundry in a conventional manner. The impeller 120 is configured to operate as the clothes mover 100 of configuration B, that is different than the clothes mover 100 of configuration A and independent of the agitator 150, during a cycle of operation. In this manner, the laundry treating appliance 10 can be selectively re-configured by the user between the first and second configurations as illustrated to utilize two different clothes movers 100.

Further, to configure or re-configure the laundry treating appliance 10 from the first configuration, configuration A, to the second configuration, configuration B, the user removes or decouples the agitator 150 and sets it aside. Optionally, the laundry treating appliance 10 can be configured to facilitate storage of the removable agitator 150 when not in use. For example, the laundry treating appliance 10 can include a storage element that suspends the removable agitator 150 from the laundry treating appliance 10, such as a hook, clamp, hanger, or suspending rod. In another example, the storage element can be in the form of a shelf, drawer, or cavity configured to support the removable agitator 150. In another aspect of the disclosure, a companion laundry dryer or laundry module can include the storage element configured to store the removable agitator 150.

Figure 3:
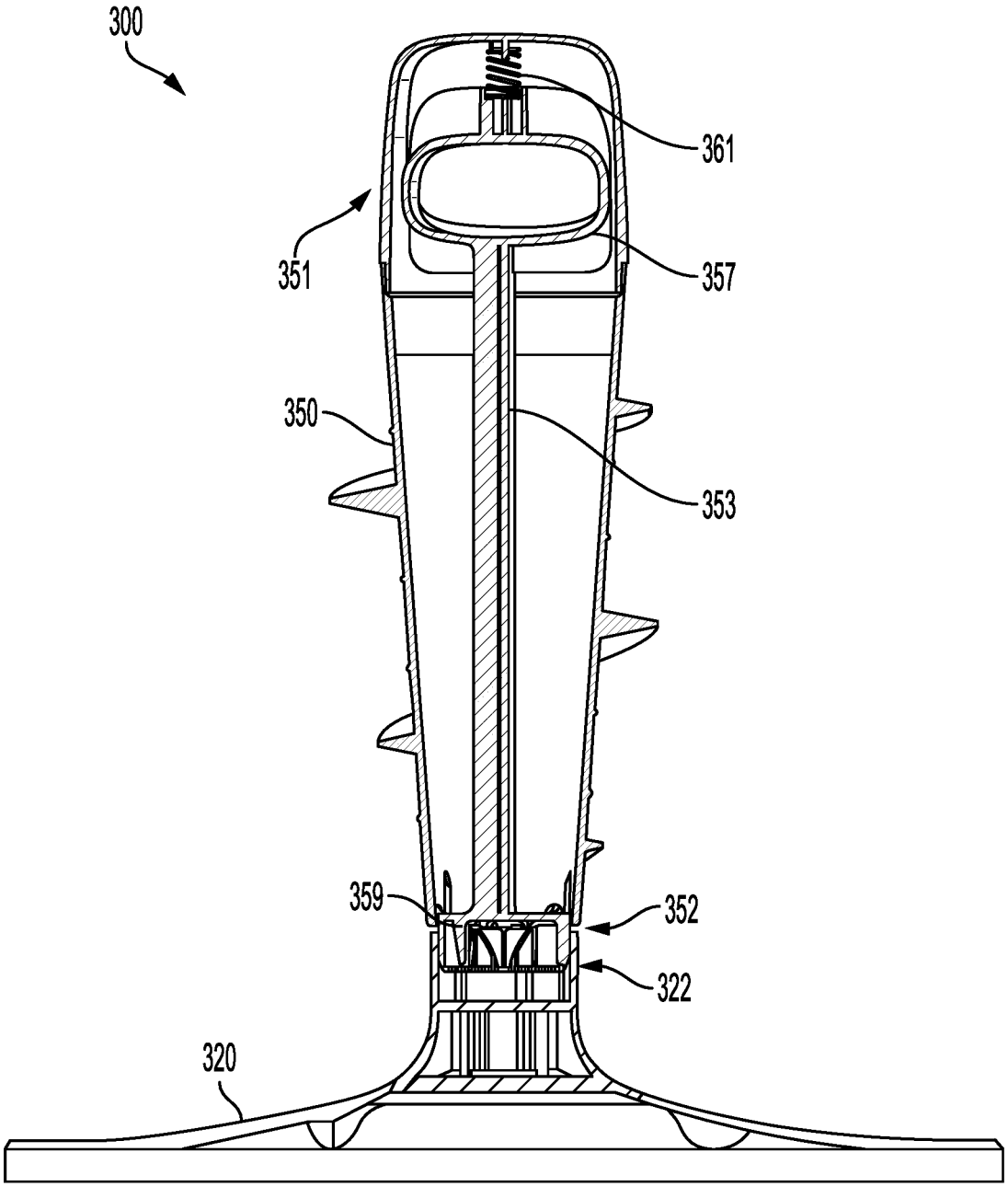
FIG. 3 is a perspective cross-sectional view of an agitator coupling to an impeller for use with the clothes mover and laundry treating appliance of FIG. 1.

Referring now to FIG. 3, an agitator 350 is coupled to an impeller 320 to form a clothes mover 300 using a bayonet mount-type connection. The agitator 350 includes a grip portion, illustrated herein as a handle portion 351 at an upper end of the agitator 350. The handle portion 351 can facilitate insertion, removal, and storage of the agitator 350 by the user by giving the user a convenient handle to grip onto and to rotate the agitator 350 as needed. The agitator 350 further includes a handle pull locking post 353 provided within the interior of the agitator 350, such that the locking post 353 is nested within the agitator 350. The locking post 353 can include a handle pull portion 357 positioned such that the user can grip the handle portion 351 of the agitator 350 and the handle pull portion 357 of the locking post 353 at the same time. The locking post 353 further defines at least one pin 359 protruding downwardly from a lower end of the locking post 353. The at least one pin 359 can be thought of as forming a portion of the first connector 352. The locking post 353 can be movable within and relative to the agitator 350, for example such that the locking post 353 is vertically slidable within and relative to the agitator 350 between a lower, locking position and a raised position. A biasing element, illustrated herein as a handle pull spring 361 that extends between the handle portion 351 and the handle pull portion 357 so as to bias the locking post 353 downwardly from the handle portion 351 when not compressed by the user.

Figure 4:
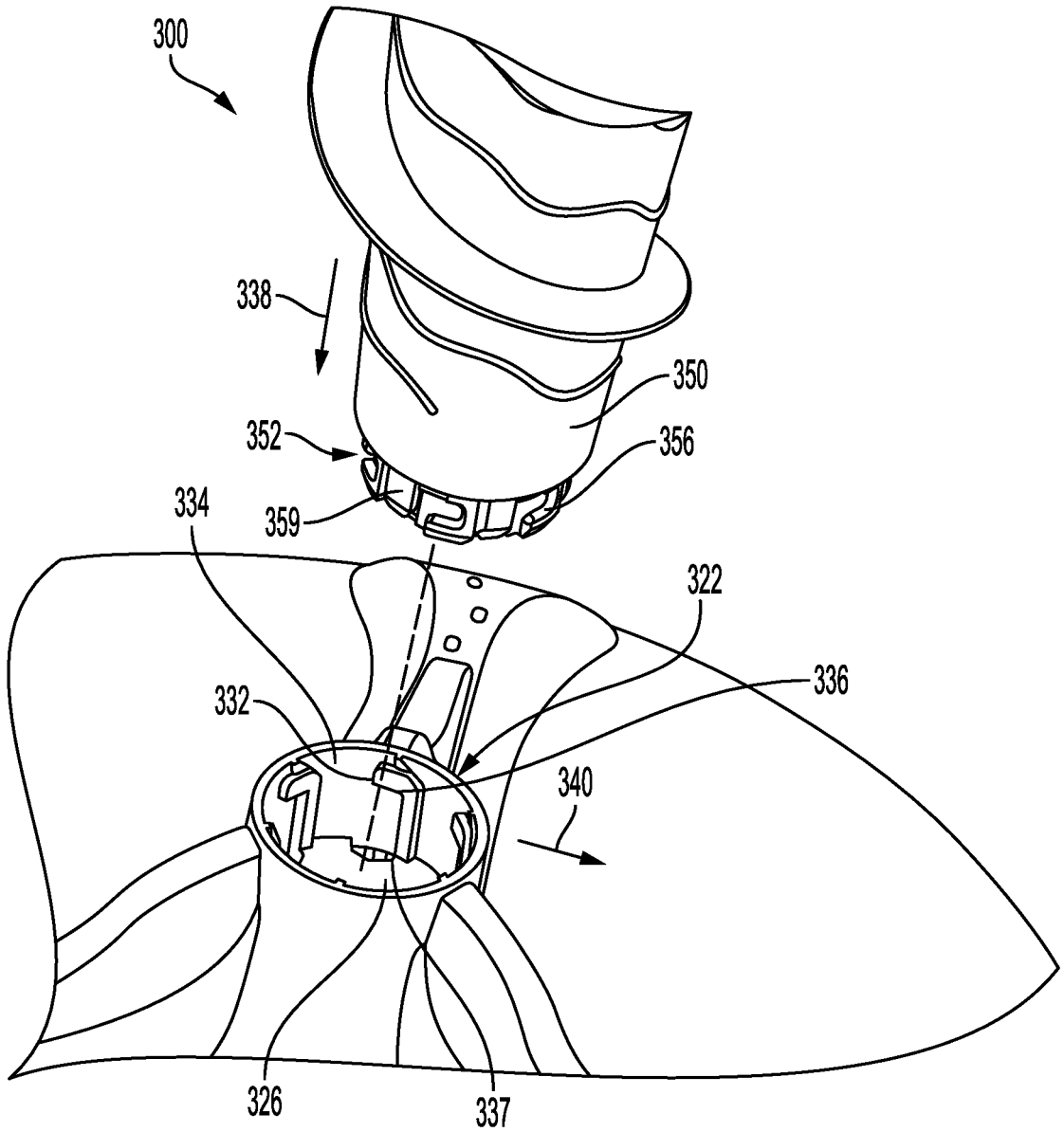
FIG. 4 is a perspective view of the agitator coupling to the impeller of FIG. 3.

FIG. 4 illustrates the second connector 322 including at least one channel 332 configured to receive at least one pin 356 carried by the first connector 352. The at least one pin 359, illustrated herein as a plurality of pins 359, can protrude downwardly from the locking post 353, and thus also from the agitator 350, adjacent the at least one pin 356. In one example, the pins 359 and the pins 356 can be provided in an alternating manner, such that the pins 359 are received between the pins 356. The second connector 322 can further define at least one locking opening 337, which can be provided in a bottom wall of the second connector 322. The second connector 322 optionally includes a biasing element, such as at least one spring, within the socket 326 which is compressed within the socket 326 when the agitator 350 is coupled with the impeller 320, as illustrated in FIG. 3.

Figure 20:
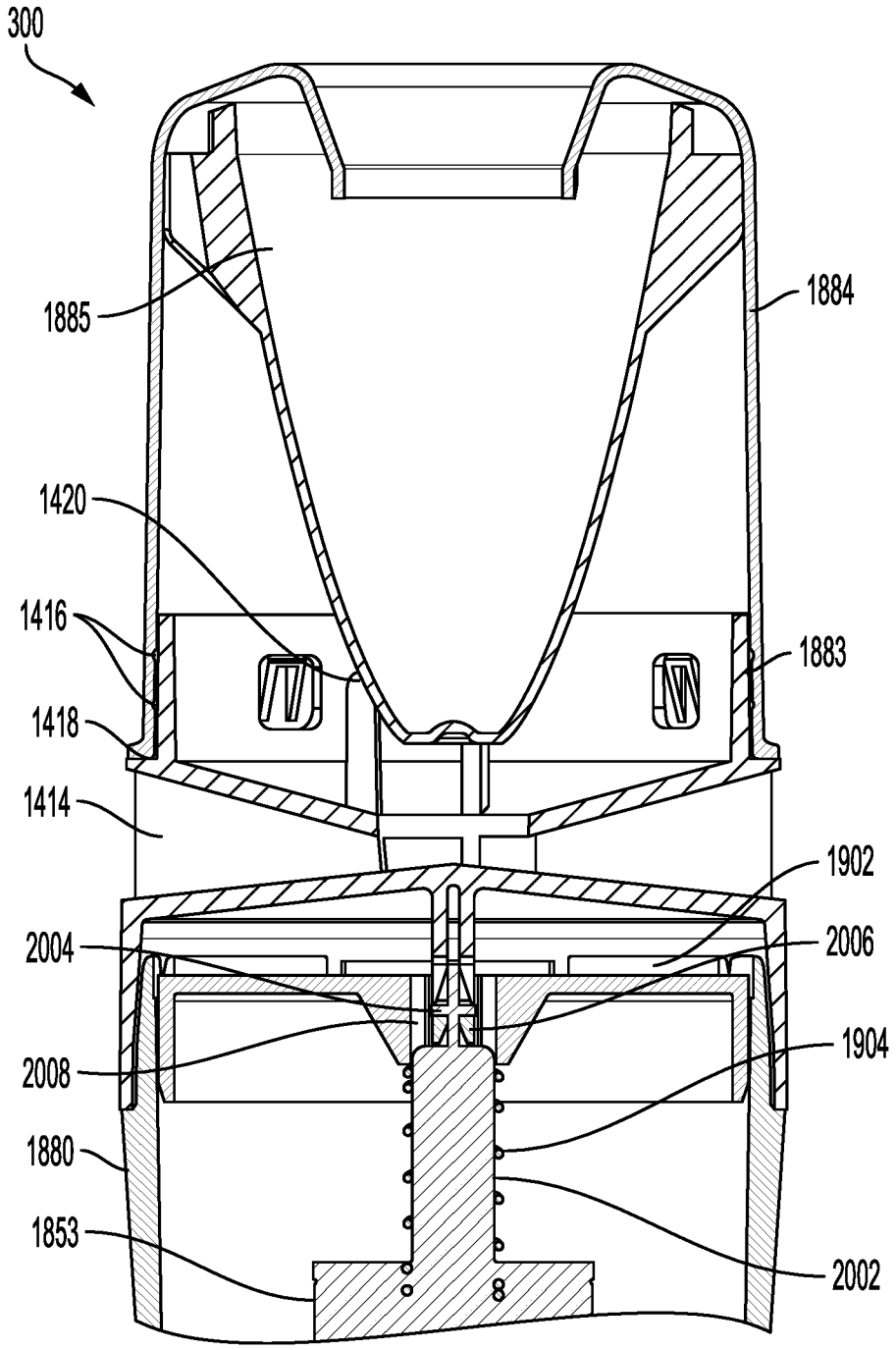
FIG. 20 illustrates a side cutaway view of the removable agitator.

To assemble the clothes mover 300, the agitator 350 is aligned with the impeller 320 such that the at least one pin 356 is aligned with at least one opening 334 of the channels 332. It is contemplated that the user can grip the agitator 350 by the handle portion 351 during insertion of the agitator 350 into the impeller 320. Further, the user can also grip the handle pull portion 357 of the locking post 353 at the same time, compressing the handle pull spring 361 and holding the locking post 353 in the raised position. The agitator 350 is moved toward the impeller 320, as illustrated by arrow 338, to insert the first connector 352 into the second connector 322. As the first connector 352 is inserted into the second connector 322, the pin 356 travels into the channel 332. The locking post 353 can be maintained in the raised position by the grip of the user against the handle pull portion 357 and the handle portion 351. The agitator 350 is then rotated, as illustrated by arrow 340, to move the pin 356 into a lock portion 336 of the channel 332, as illustrated in FIG. 20. In one example, the at least one locking opening 337 can be positioned beneath the lock portion 336 of the channel 332. Further, the first and second connectors 352, 322 can be positioned and sized such that the locking post 353 must be held in the raised position to prevent the pins 359 from protruding downwardly beyond the pins 356 and in order for the agitator 350 to be rotated as illustrated by arrow 340.

Figure 5:
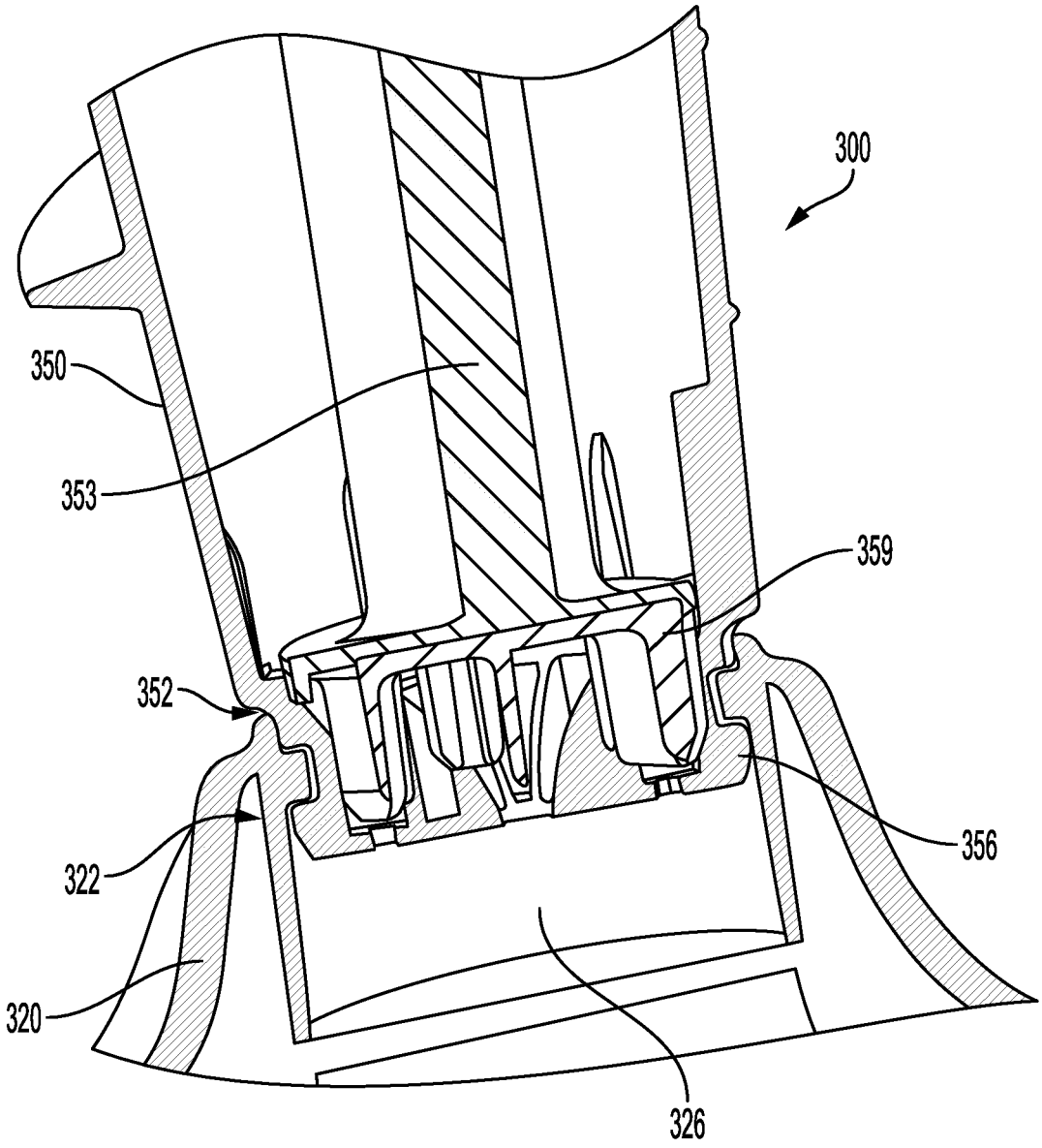
FIG. 5 is a cross-sectional view of the agitator coupling to the impeller of FIG. 3 in a first position.

In FIG. 5, the agitator 350 is coupled with the impeller 320, with the pins 356 engaging the lock portion 336 of the channel 332. The locking post 353 is still provided in the raised position, such that the pins 359 do not exceed downwardly beyond the pins 356. When the agitator 350 is coupled with the impeller 320, the spring (not shown), or other biasing element, biases the agitator 350 away from the impeller 320, facilitating maintaining the pin 356 in the lock portion 336. The spring (not shown) applies a force that presses the agitator 350, and thus the pin 356, upward, which presses the pin 356 upwardly against the wall forming the lock portion 336. Biasing the pin 356 against the wall of the lock portion 336 can inhibit unintended rotation of the agitator 350 relative to the impeller 320 during a cycle of operation into a position in which the pin 356 is aligned with the channel opening 334, which could result in unintended uncoupling of the agitator 350 from the impeller 320.

Figure 6:
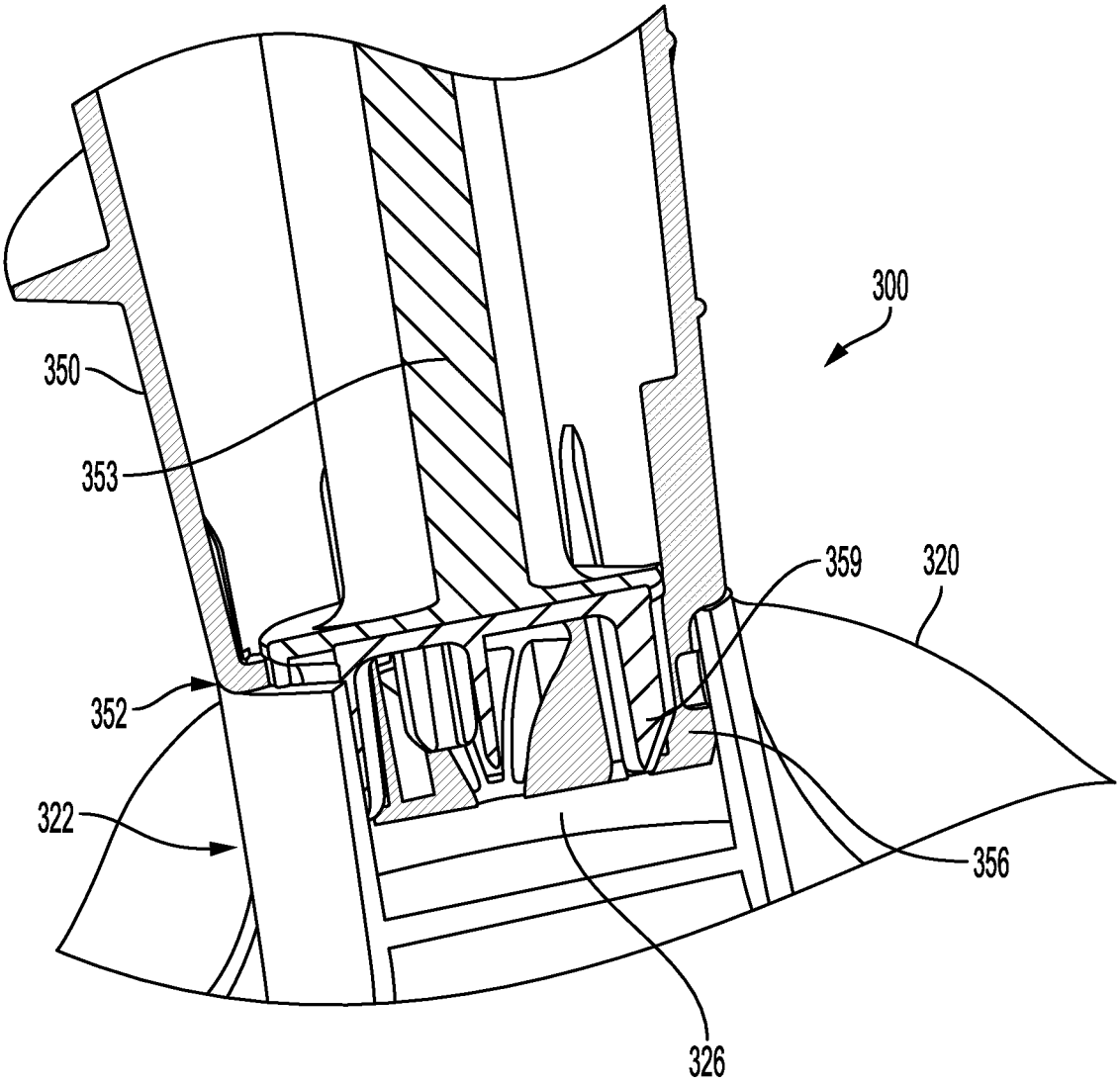
FIG. 6 is a cross-sectional view of the agitator coupling to the impeller of FIG. 3 in a second position.

Referring now to FIG. 6, and in order to further inhibit unintended rotation of the agitator 350 relative to the impeller 320 during a cycle of operation, once the agitator 350 has been rotated to move the pins 356 into the lock portion 336, the pins 359 of the locking post 353 overlie and are aligned with the locking openings 337. The user can release the handle pull portion 357 and the handle portion 351, allowing the handle pull spring 361 to bias the locking post 353 downwardly. As the handle pull spring 361 biases the locking post 353 downwardly, the pins 359 are moved downwardly to be inserted into and received within the locking openings 337. When the pins 359 are received within the locking openings 337, unintended rotation of the agitator 350 relative to the impeller 320 during a cycle of operation is inhibited. Further, the engagement between the pins 356 and the lock portion 336 prevents unintended vertical movement of the agitator 350 relative to the impeller 320.

To uncouple the agitator 350 from the impeller 320, the user can again grip the agitator 350 by the handle portion 351 and can also grip the handle pull portion 357 of the locking post 353 and compress the handle pull spring 361 to hold the locking post 353 in the raised position, withdrawing the pins 359 from the locking openings 337, to permit rotational movement of the agitator 350. The agitator 350 can then be rotated in the opposite direction of arrow 340 of FIG. 4 until the pins 356 are no longer aligned with the lock portion 336 and are instead aligned with the at least one opening 334 of the channels 332. When the pins 356 are aligned with the at least one opening 334, the agitator 350 can be withdrawn in the opposite direction of arrow 338 of FIG. 4.

An advantage of the aspects described herein is that providing a laundry treating appliance 10 with customizability yields even more customizable options due to combinability of different features to make new combinations. Another aspect which provides customizability to the laundry treating appliance 10 is that the clothes movers can include a wide variety of additional options, features, or utilities that can be coupled with the agitator kits.

Figure 7:
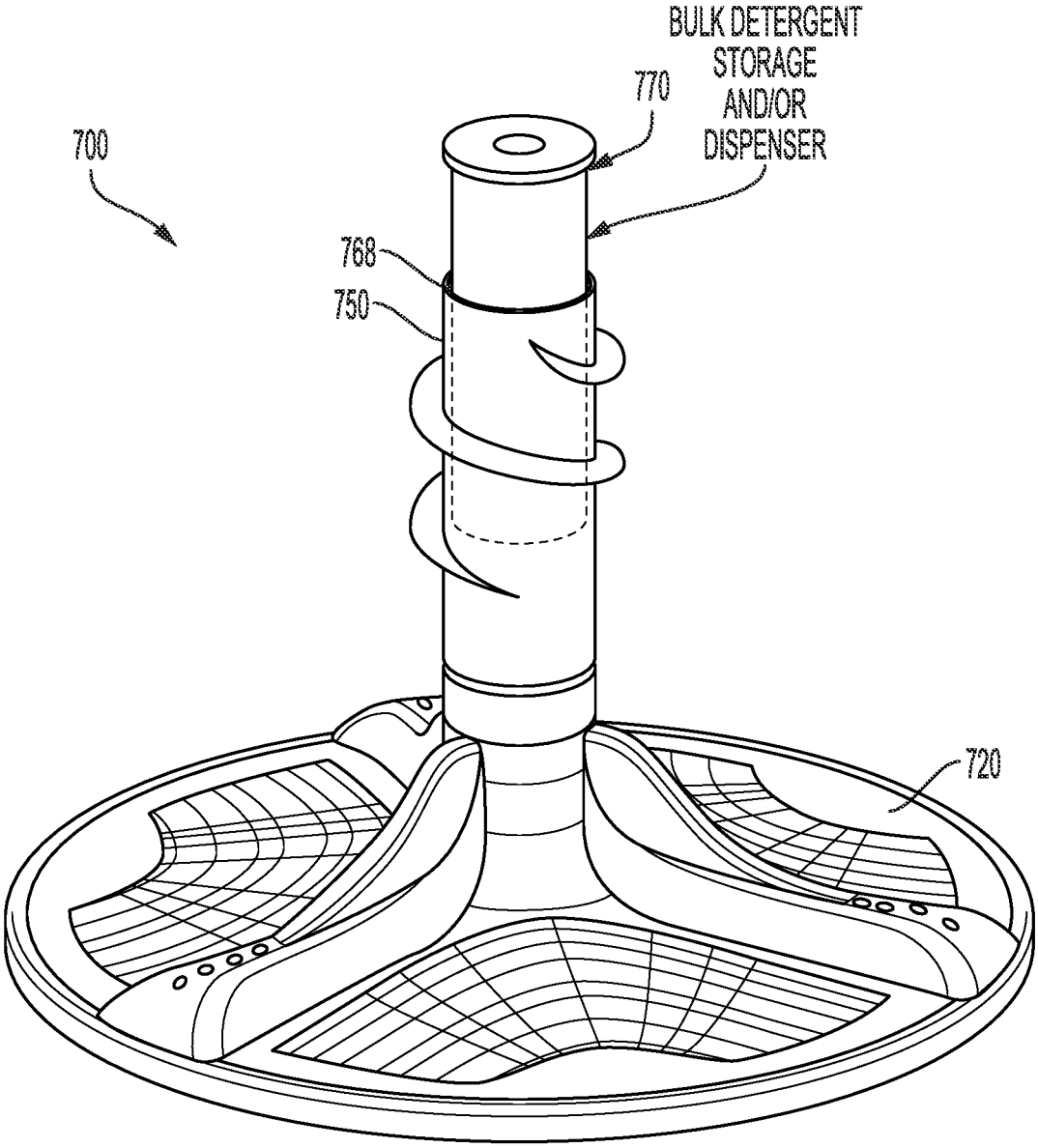
FIG. 7 is a schematic perspective view of another example of an impeller coupling to an agitator for use with the clothes mover and laundry treating appliance of FIG. 1.

FIG. 7 illustrates a clothes mover 700 including an impeller 720 and an agitator 750, and further comprising an example of at least one additional utility feature that can be included with the clothes mover 700. In this example, the clothes mover 700 can include an interior 768 of the agitator 750 that is configured to receive a bulk detergent storage reservoir 770, which can function for the storage and dispensing of detergent or other laundry chemistry.

Figure 8:
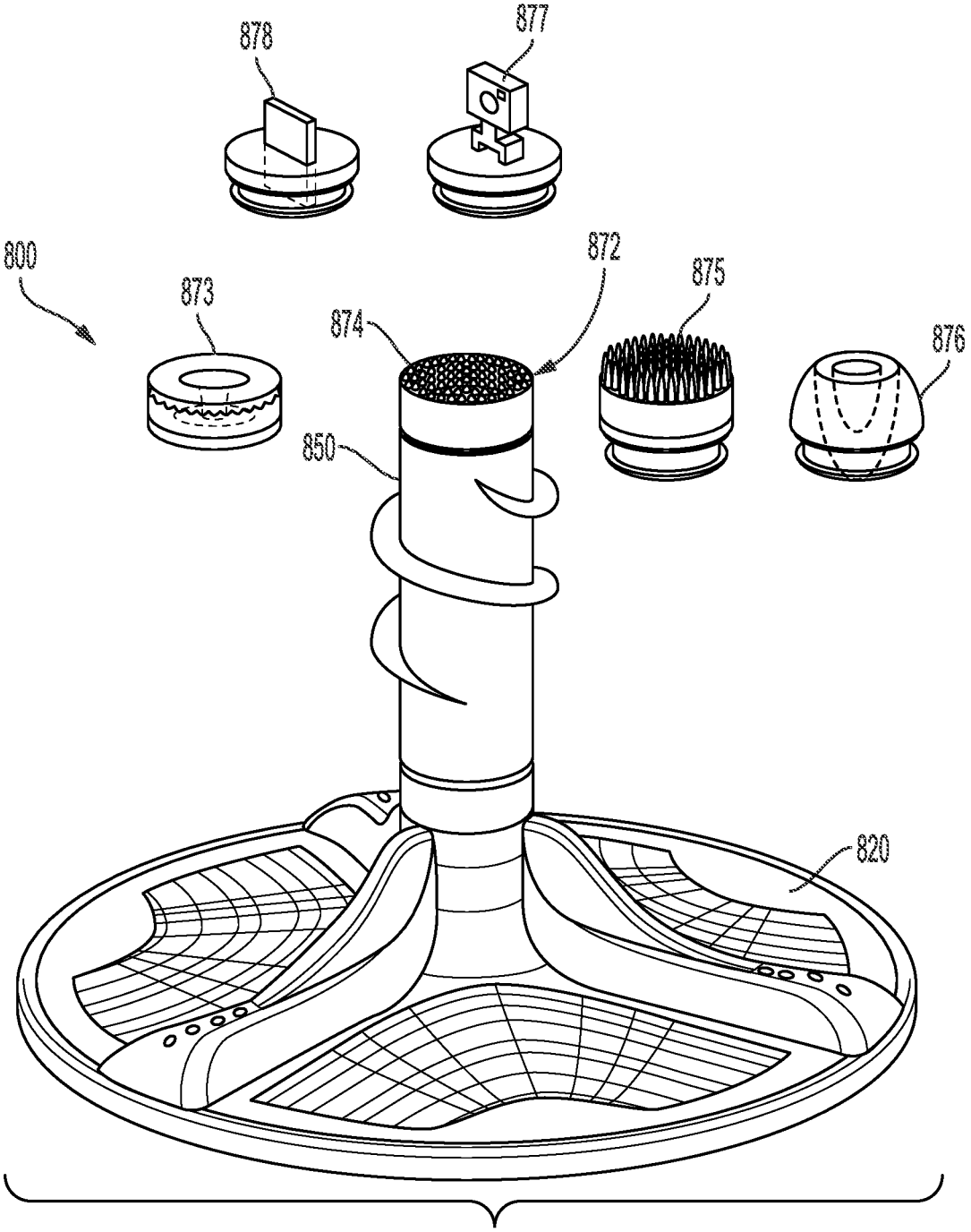
FIG. 8 is a schematic perspective view of another example of an impeller coupling to an agitator for use with the clothes mover and laundry treating appliance of FIG. 1.

FIG. 8 illustrates a clothes mover 800 including an impeller 820 and an agitator 850, and further comprising an example of at least one additional utility feature that can be included with the clothes mover 800. In this example, the clothes mover 800 can include an agitator cap 872 that is configured to function as an accessories holder for receiving a variety of different accessories or add-on features. For example, the agitator cap 872 can receive a pre-treatment detergent dispenser 873, a scrubber 874 defining a scrubbing surface for soiled laundry items, a bristled scrubber 875 for heavy-duty laundry items, another cleaning agent dispenser 876, such as a centrifugal fabric softener dispenser, a smartphone dock 878, or a camera mount 877 for a camera or other video monitoring device. In the case of the smartphone dock 878 or the camera mount 877, the devices can, in one example, be WiFi-, Bluetooth-, or other-electronically connected. In addition, the devices can be used for sensors. In the case that sensors are used, they may likely be WiFi-communicating sensors. For example, the user may wish to video monitor the inside of the laundry machine to see if there is, perhaps, an off-balance load generating within the treating chamber 32 by viewing the treating chamber 32 using a camera or a GoPro. Another example would be to use the phone to check the temperature within the laundry treating appliance 10 by using the thermal imaging feature.

Figure 9:
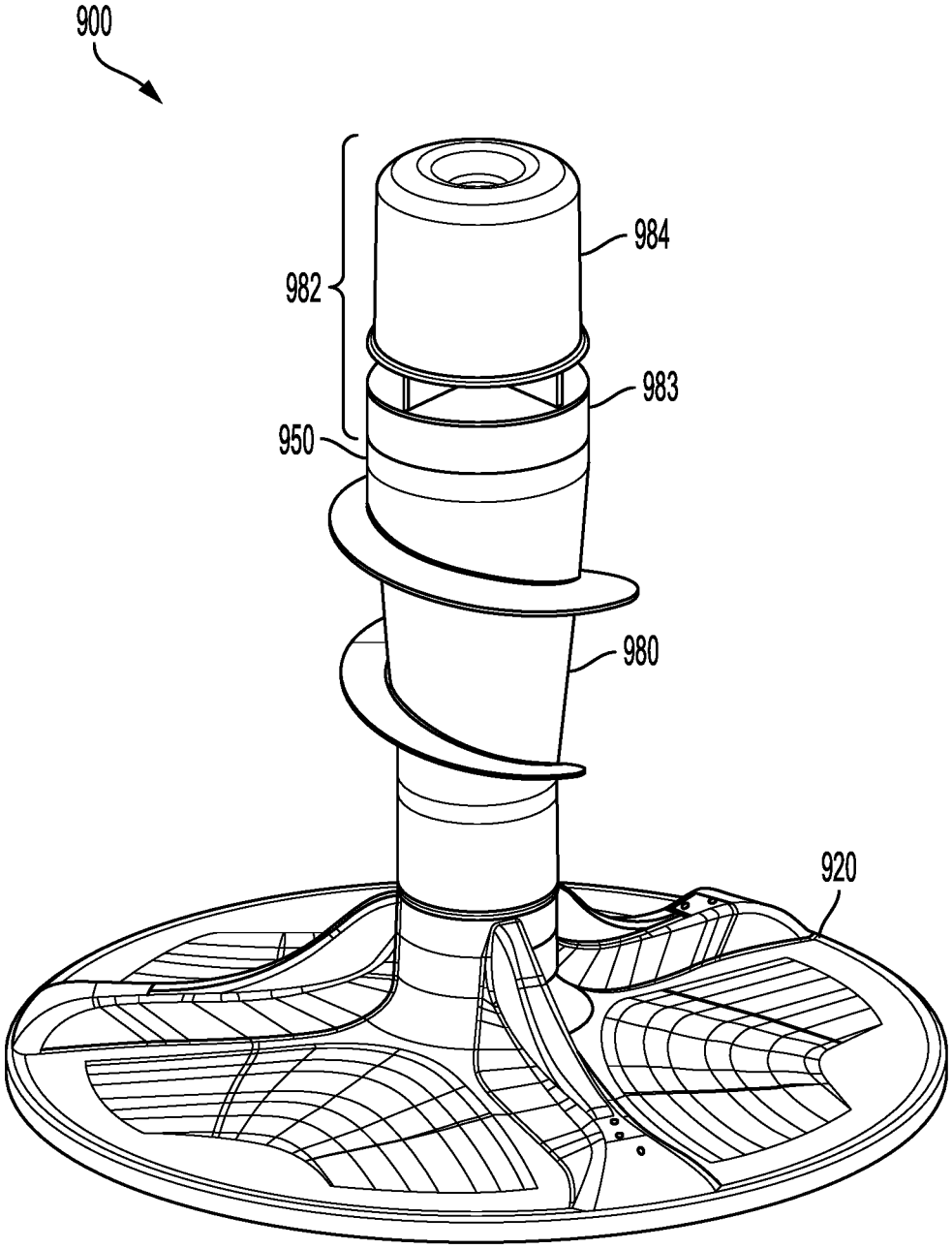
FIG. 9 is a perspective view of the removable agitator installed to the impeller, in accordance with an embodiment of the disclosure.
Figure 10:
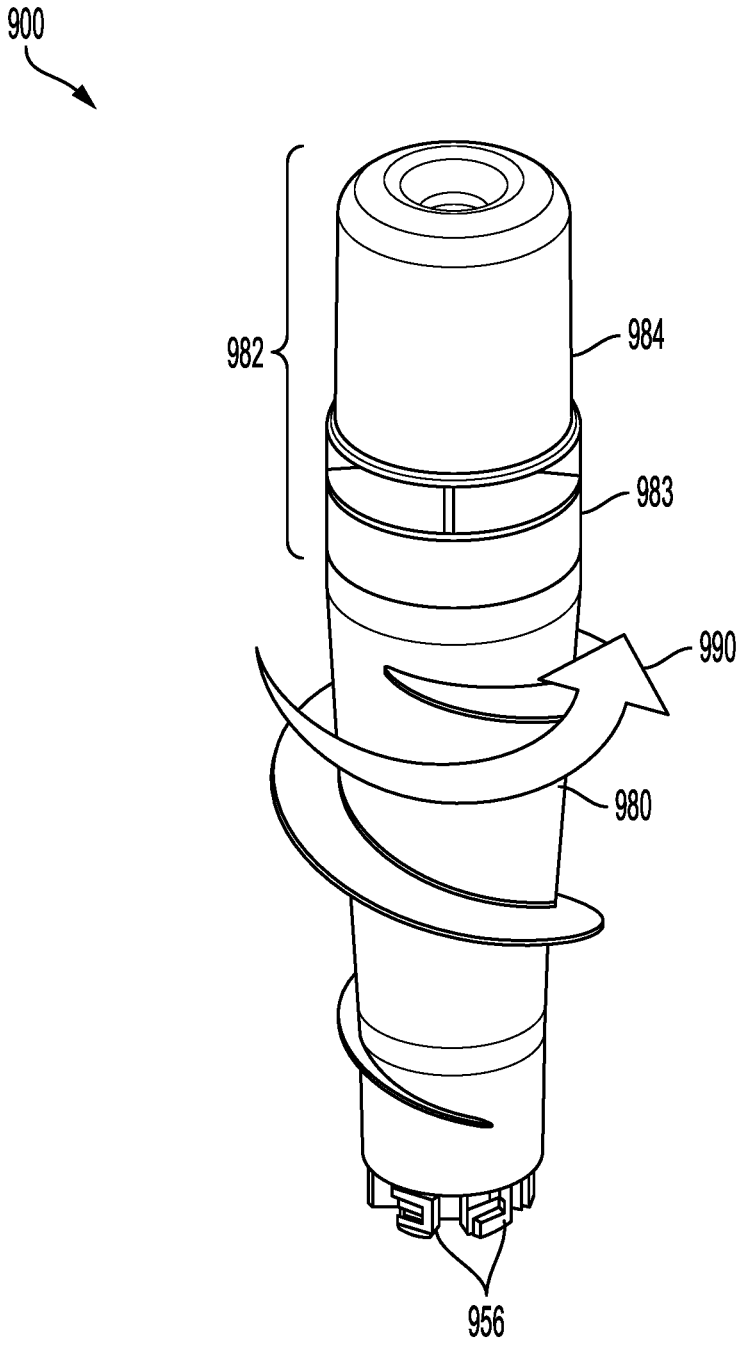
FIG. 10 is a perspective view of the removable agitator of FIG. 9 detached from the impeller.
Figure 11:
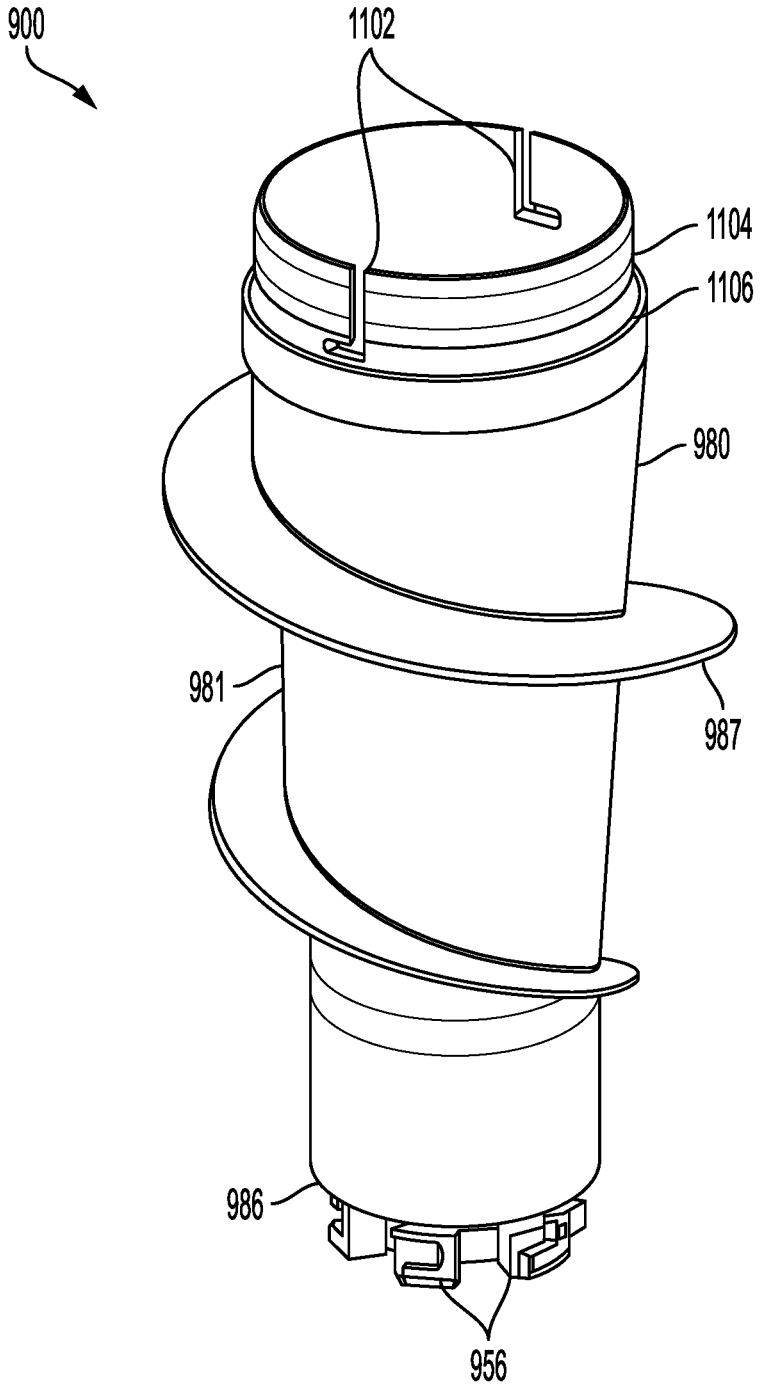
FIG. 11 is a perspective view of the removable agitator barrel of the removable agitator of FIG. 9.
Figure 12:
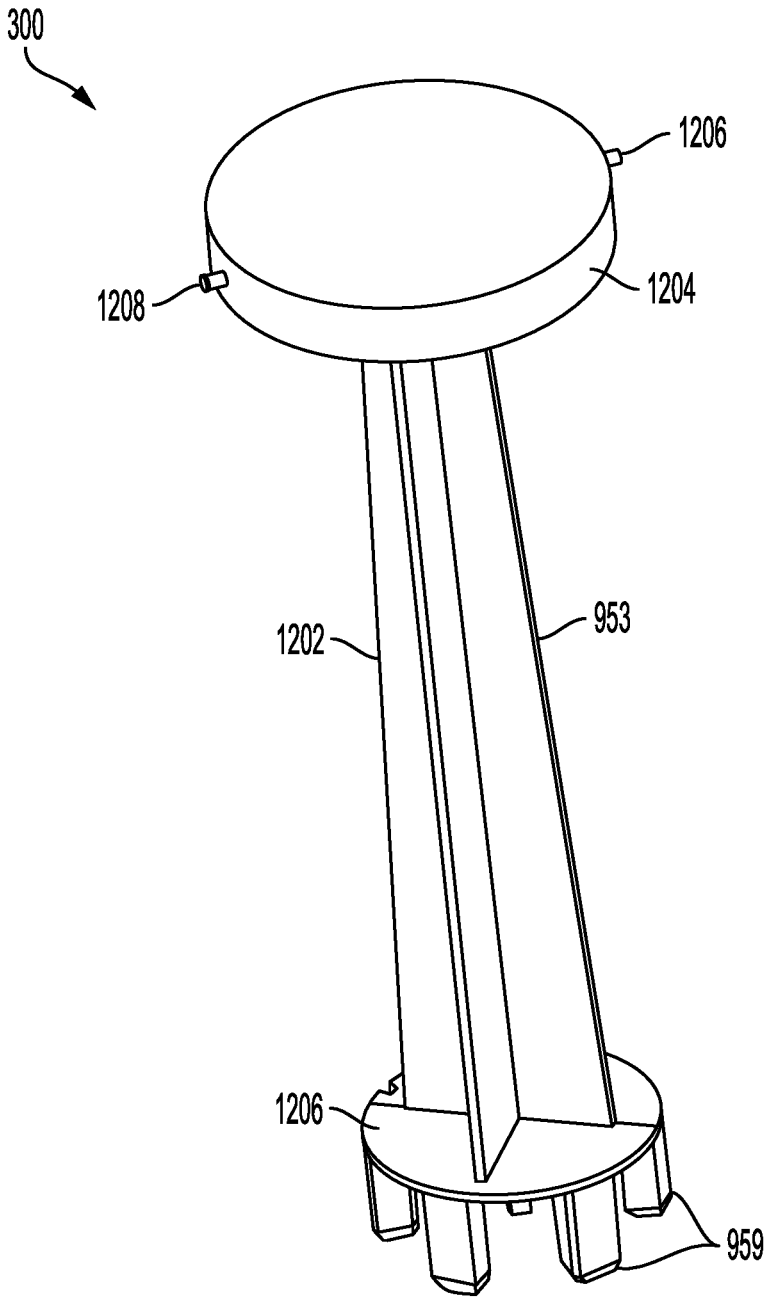
FIG. 12 is a perspective view of the locking post of the removable agitator of FIG. 9.
Figure 13:
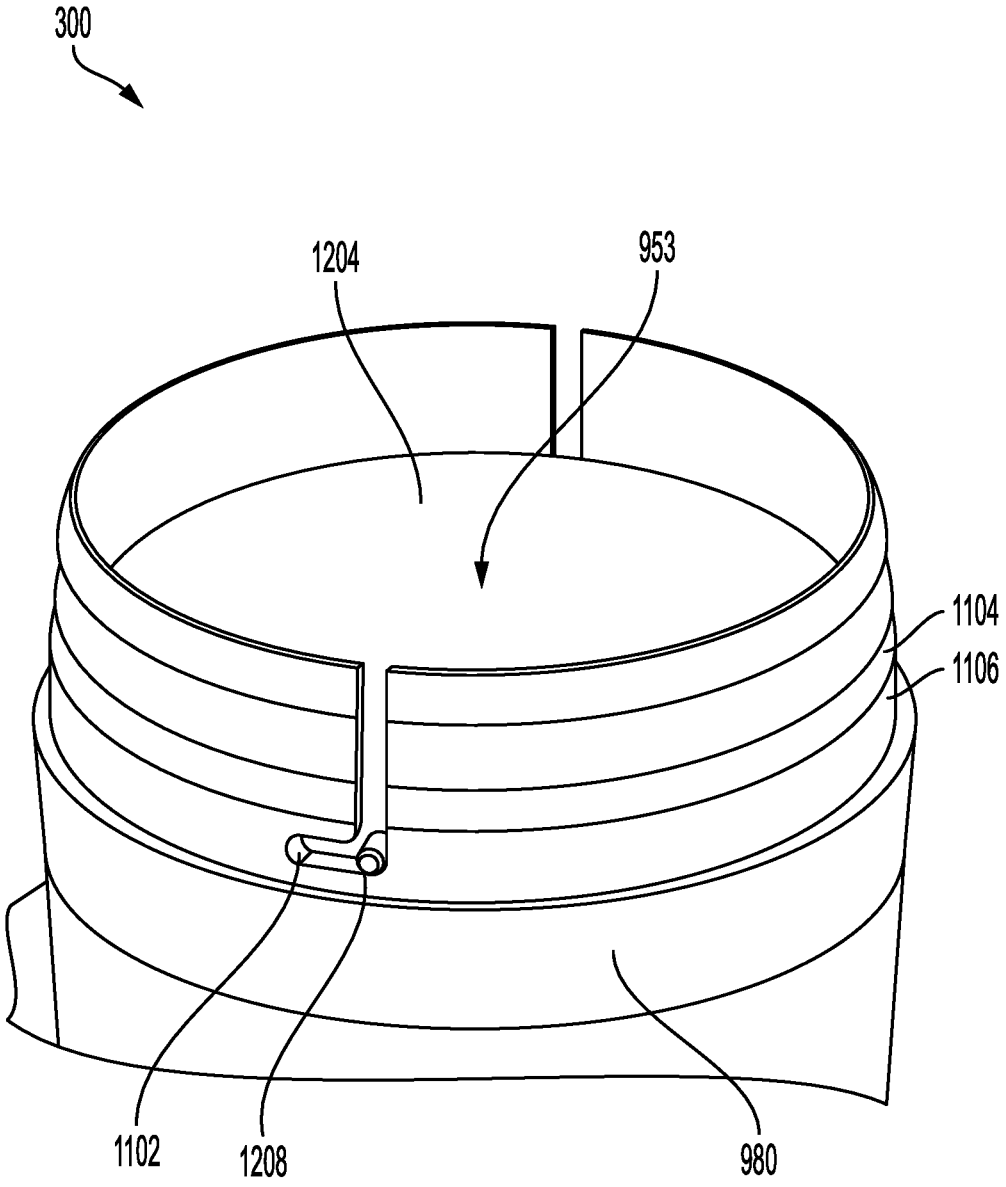
FIG. 13 is a perspective view of the locking post installed to the agitator barrel of the removable agitator of FIG. 9.
Figure 14:
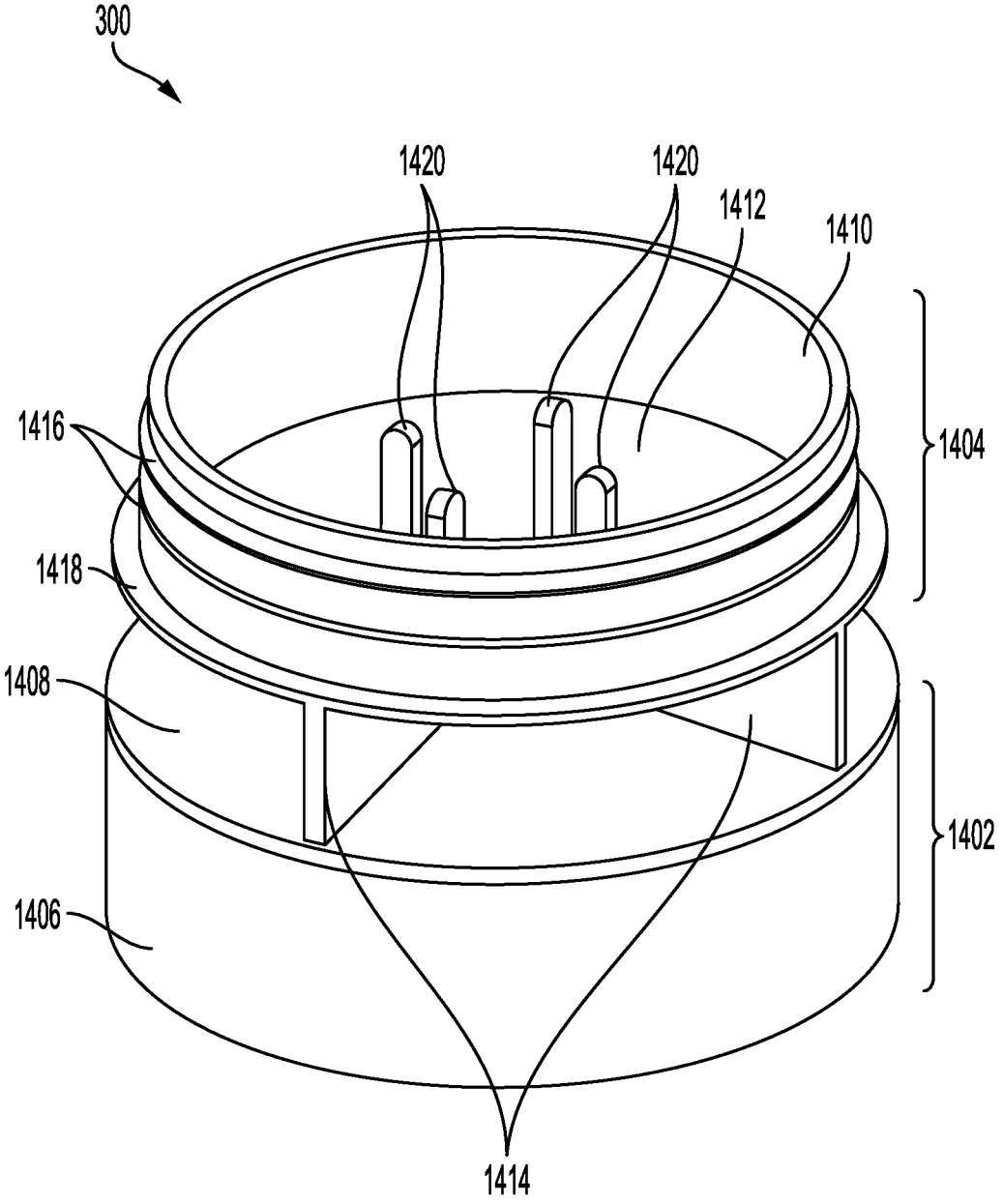
FIG. 14 is a perspective view of a dispenser cap of the removable agitator of FIG. 9.
Figure 15:
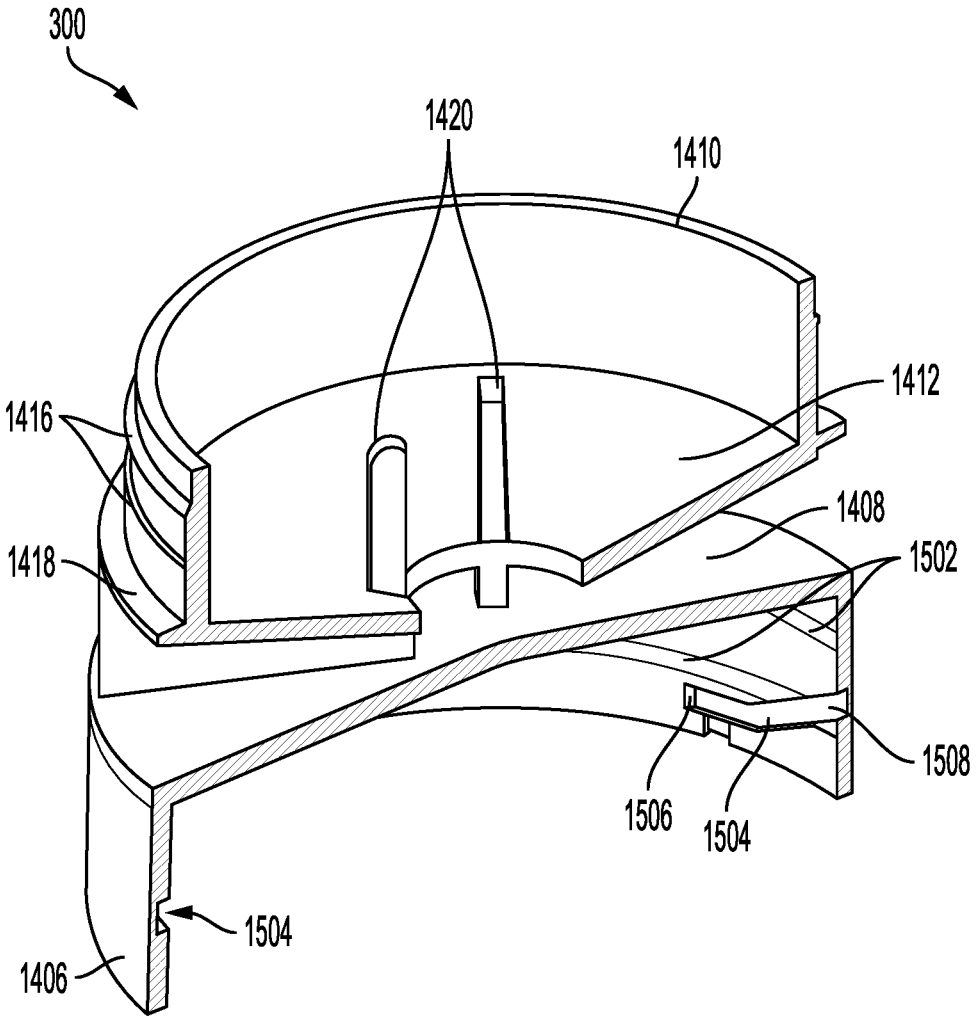
FIG. 15 is a cross-sectional perspective view of the dispenser cap of the removable agitator of FIG. 9.
Figure 16:
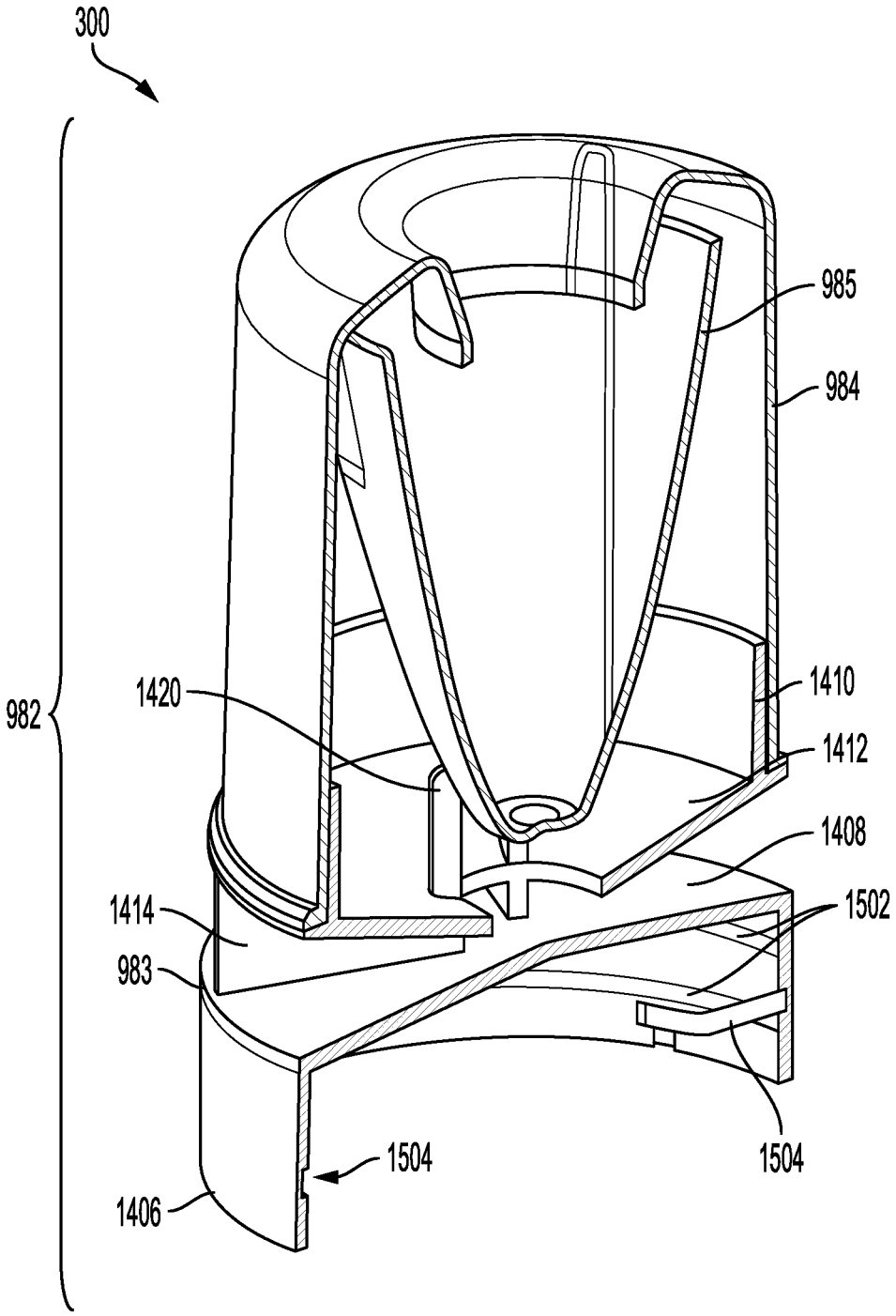
FIG. 16 is a cross-sectional perspective view of the dispenser cap with the dispenser cap top and the dispenser cup installed of the removable agitator of FIG. 9.
Figure 17:
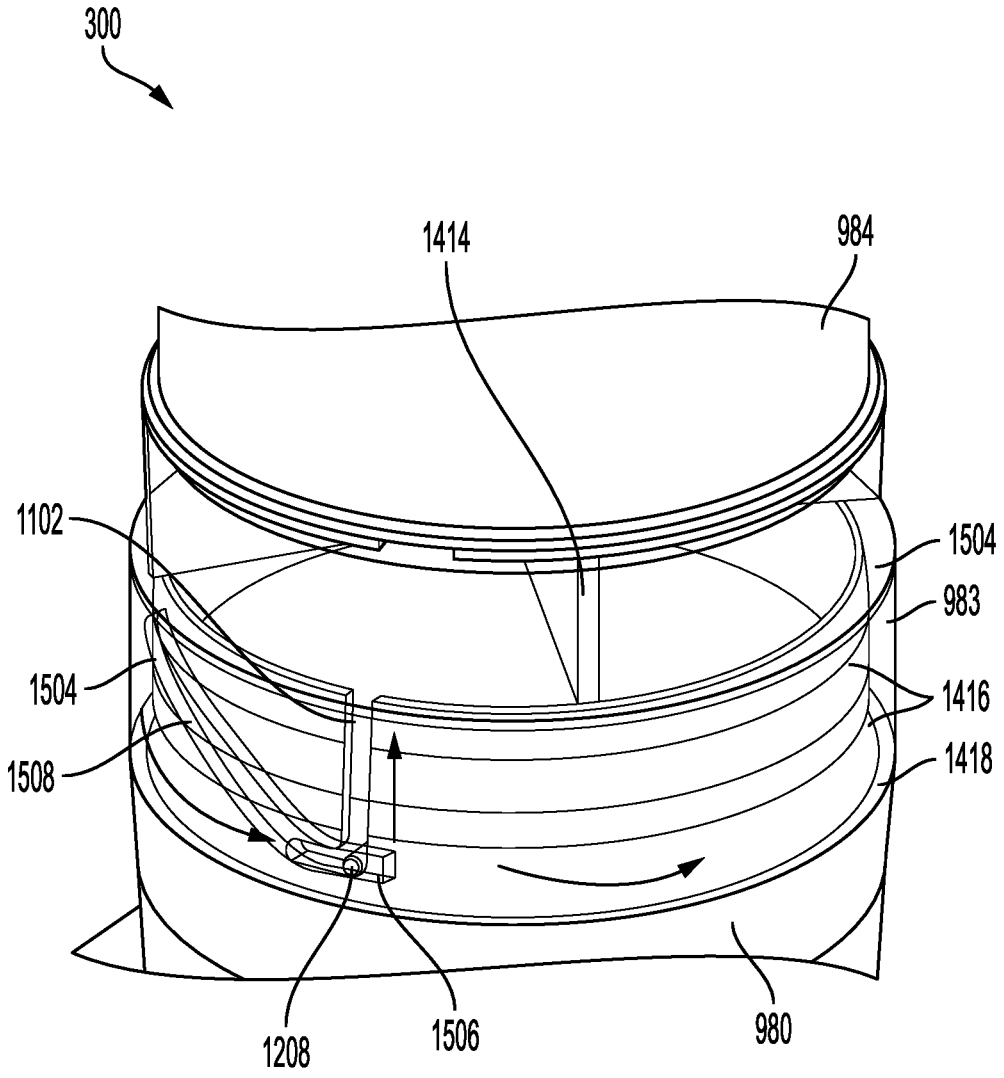
FIG. 17 is a perspective view of the locking post and dispenser cap installed to the agitator barrel of the removable agitator of FIG. 9.

FIGS. 9-17 describe an embodiment of a removable agitator 950 having dispensing capabilities. In this example embodiment, the removable agitator 950 utilizes a rotatable dispenser cap assembly 982 to facilitate locking and unlocking of the removable agitator 950 from an impeller 920. FIG. 9 is a perspective view of the removable agitator 950 installed to the impeller 920. FIG. 10 is a perspective view of the removable agitator 950 detached from the impeller 320. FIG. 11 is a perspective view of an agitator barrel 980 of the removable agitator 950. FIG. 12 is a perspective view of a locking post 953. FIG. 13 is a perspective view of the locking post 353 installed to the agitator barrel 980. FIG. 14 is a perspective view of a dispenser cap base 983 of a dispenser cap assembly 982. FIG. 15 is a cross-sectional perspective view of the dispenser cap assembly 982. FIG. 16 is a cross-sectional perspective view of the dispenser cap assembly 982 with a dispenser cap top 984 and a dispenser cup 985 installed to the dispenser cap base 983. FIG. 17 is a perspective view of the locking post 953 and dispenser cap assembly 982 installed to the agitator barrel 980.

FIG. 9 shows a perspective view of the removable agitator 950 installed to an impeller 920. This may correspond to the configuration A discussed above with respect to FIG. 2. The removable agitator 950 may generally include an agitator barrel 980 and a dispenser cap assembly 982. The dispenser cap assembly 982 may include a dispenser cap base 983, a dispenser cap top 984, and a dispenser cup 985.

FIG. 10 is a perspective view of the removable agitator 950 detached from the impeller 320. This may correspond to the configuration B discussed above with respect to FIG. 2. As can be more clearly seen in FIG. 10, the at least one pin 956 of the agitator barrel 980 are present the base of the removable agitator 950 for insertion and removal from the impeller 920, similar to as discussed above with respect to the agitators 150, 350, and 750.

FIG. 11 illustrates the agitator barrel 980 in further detail. As best seen in FIG. 11, the agitator barrel 980 defines a generally cylindrical peripheral wall extending upward from a base to an open top. In some examples, the peripheral wall may taper outward from the base for at least a portion of its height, such that the diameter of the agitator barrel 980 increases upwards from the base. As shown, the agitator barrel 980 defines a single spiraling vane extending peripherally outward from the peripheral wall. However, it should be noted that the exterior of the agitator barrel 980 may include any configuration of vanes, blades, or other structural features for imparting mechanical energy to laundry items during a cycle of operation.

The top of the agitator barrel 980 may define an annular snap fit onto which the dispenser cap assemblies 982 may be connected. For example, the top of the agitator barrel 980 may define one or more circumferential ridges 1104 to hold against an inner surface of a peripheral wall of the dispenser cap assembly 982. The agitator barrel 980 may also define a stop 1106 defining a limit for the attachment of the dispenser cap assembly 982 to the top of the agitator barrel 980. When attached, the agitator barrel 980 may be captured vertically but free to rotate via the circumferential ridges 1104 with respect to the agitator barrel 980.

As best shown in FIG. 12, the locking post 953 may include a generally elongate body 1202, with a generally cylindrical portion 1204 positioned at the upper end of the locking post 953. The locking post 953 may further define a locking end 1206 having at least one pin 759 protruding downwardly from a lower end of the locking post 953. The locking post 953 may be movable within the removable agitator 950, such that the locking post 953 is vertically slidable within and relative to the removable agitator 950 between a lower, locking position and a raised, unlocked position.

The agitator barrel 980 may further define one or more L-shaped channels 1102 extending downward from the open top, as best shown in FIG. 11. These L-shaped channel 1102 may be configured to receive corresponding radial pins 1208 of the locking post 953, forming a bayonet-style mount as shown in FIG. 12. Similar to the locking post 353, when assembled the locking post 953 may be provided within the interior of the agitator barrel 980 of the removable agitator 950, such that the locking post 953 is nested within the agitator barrel 980, as shown in FIG. 13. The center of the generally cylindrical portion 1204 may be attached to but be free to rotate with respect to the long axis of the locking post 953 to allow the radial pins 1208 to move into and out of the L-shaped channels 1102.

When the locking post 953 is assembled to the agitator barrel 980, the movement of the locking post 953 within the agitator barrel 980 is guided by the travel of the radial pins 1208 within the corresponding L-shaped channels 1102. Thus, the locking post 953 may only vertically slide between the lower, locking position and the raised, unlocked position when the radial pins 1208 are within the vertical portion of the L-shaped channels 1102. When the radial pins 1208 are within the horizontal portions of the L-shaped channels 1102, the locking post 953 may instead be locked in the lower, locking position.

FIG. 14 illustrates a perspective view of the dispenser cap base 983 of the dispenser cap assembly 982. As shown, the dispenser cap base 983 may define a lower portion 1402 configured to connect to the top of the agitator barrel 980. The dispenser cap base 983 may further define an upper portion 1404 to hold the dispenser cap top 984.

The lower portion 1402 may define a peripheral wall 1406 extending downward from a lower base 1408. Additionally, the upper portion 1404 may similarly define a peripheral wall 1410 extending upward from an upper base 1412. One or more vertical supports 1414 may connect the top of the lower base 1408 to the bottom of the upper base 1412. As shown, the dispenser cap base 983 includes four equally spaced radial vertical supports 1414, but this is only an example and different arrangements of vertical supports 1414 may be used.

The peripheral wall 1410 may define an annular snap fit onto which the dispenser cap top 984 may be connected. For example, the exterior surface of the peripheral wall 1410 may define one or more circumferential ridges 1416 to hold against an inner surface of the dispenser cap top 984. The upper portion 1404 may also define a stop 1418 defining a limit for the attachment of the dispenser cap top 984 to the top of the dispenser cap base 983.

Within the upper portion 1404, the dispenser cap base 983 may further define a dispenser cup connector 1420 to fix the dispenser cup 985 into position. As shown, the dispenser cup connector 1420 may define a plurality of tines extending vertically upward from the upper base 1412 to hold the bottom of the dispenser cup 985. As shown, the example dispenser cap base 983 includes four tines, each directly above a corresponding vertical support 1414, but this is merely one example.

As best seen in FIG. 15, the peripheral wall 1406 of the lower portion 1402 may further define one or more circumferential grooves 1502 around its inner surface. These circumferential grooves 1502 accordingly allow the dispenser cap base 983 to snap fit against the corresponding circumferential ridges 1104 of the top of the agitator barrel 980 when attached. As shown in FIG. 16, the dispenser cap top 984 and dispenser cup 985 are installed to the dispenser cap base 983.

The inner peripheral wall 1406 may further define pin tracks 1504 to allow the radial pins 1208 of the locking post 953 to additionally engage and slide within the agitator barrel 980 and dispenser cap base 983. The pin tracks 1504 may define a lower locked end 1506 at a first end and may continue to an angled portion 1508 extending upwards along the interior peripheral wall 1402 of the dispenser cap base 983.

As best seen in FIG. 17, similar to the operation of a lip-stick container mechanism, rotation of the dispenser cap base 983 may provide for locking and locking of the removable agitator 950 to the impeller 920. To move the locking post 953 into the lower, locked position, the dispenser cap base 983 may be rotated clockwise, in the illustrated example, to cause the lower locked end 1506 of the pin tracks 1504 to pull the radial pin 1208 into the horizontal potion of the L-shaped channel 1102, thereby locking the locking post 953 into the lower position in which pins 959 are extended to protrude downwardly between the pins 956.

To move the locking post 953 into the raised, unlocked position, the dispenser cap base 983 may be rotated counterclockwise, thereby causing the angled portion 1508 of the pin tracks 1504 to push the radial pin 1208 into and then upwards along the vertical portion of the L-shaped channel 1102, thereby raising the pins 959 of the locking post 953 into the upper position in which the pins 959 do not protruding downwardly between the pins 956.

To assemble the removable agitator 950 into the impeller 920, the dispenser cap base 983 is rotated counterclockwise to raise the pins 959. Then, the removable agitator 950 may be aligned with the impeller 920 such that the at least one pin 956 is aligned with at least one opening 334 of the channels 332, similar to as shown in FIG. 4. It is contemplated that the user can grip the removable agitator 950 by the dispenser cap assembly 982 during insertion of the removable agitator 950 into the impeller 920. The removable agitator 950 may be moved toward the impeller 920 to insert the least one pin 956 of the first connector 352 into the second connector 322. As the first connector 352 is inserted into the second connector 322, the pins 956 travel into the channel 332. The removable agitator 950 in its entirety may then be rotated with respect to the impeller 920 to move the pins 956 into a lock portion 336 of the channel 332. In one example, the at least one locking opening 337 can be positioned beneath the lock portion 336 of the channel 332.

The dispenser cap assembly 982 may then be turned clockwise with respect to the agitator barrel 980 of the removable agitator 950 to allow the locking post 953 to move from the raised position in which the pins 959 do not protruding downwardly between the pins 356 into the lowered position where the pins 959 are moved downwardly to be inserted into and received within the locking openings 337, to move the pins 956 into a lock portion 336 of the channel 332. This is illustrated by arrow 990 in FIG. 10. When the pins 359 are received within the locking openings 337, unintended rotation of the removable agitator 950 relative to the impeller 920 during a cycle of operation is inhibited. Further, the engagement between the pins 956 and the lock portion 336 prevents unintended vertical movement of the removable agitator 950 relative to the impeller 920.

Figure 18:
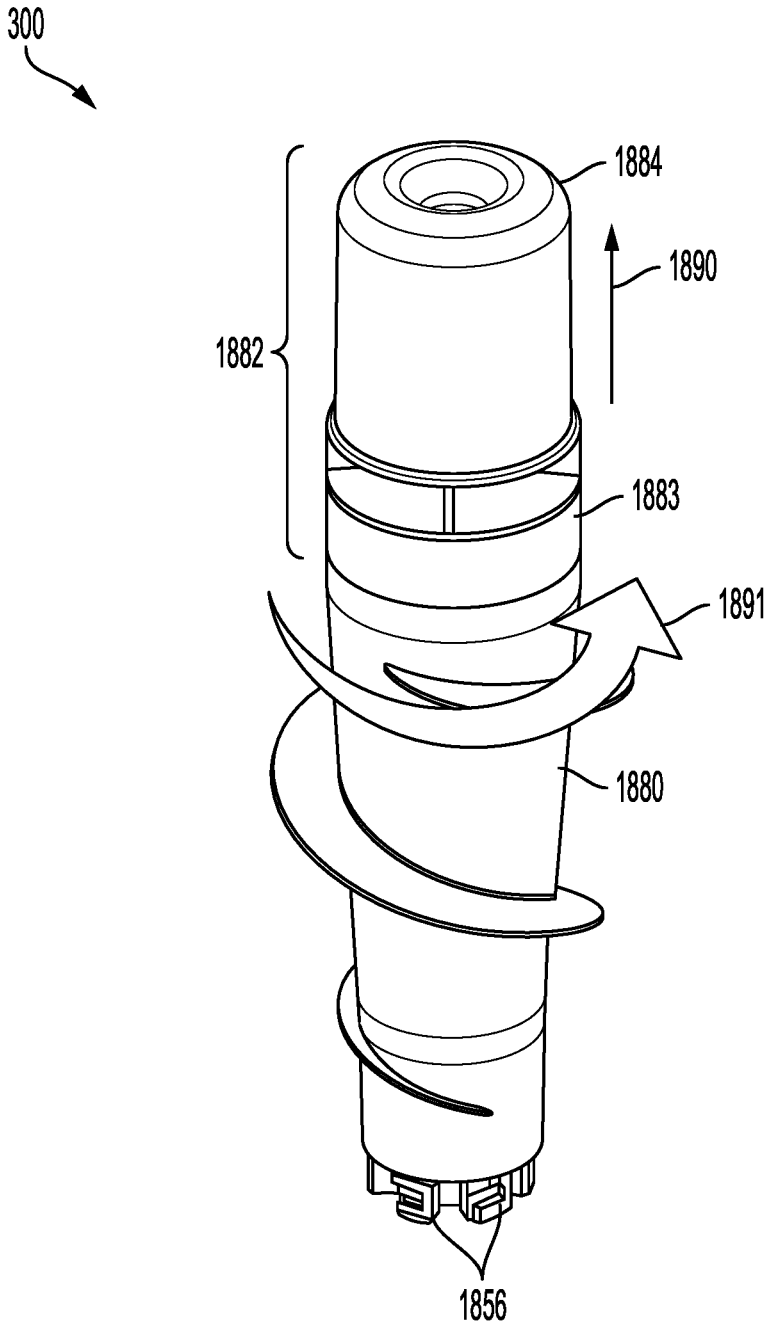
FIG. 18 illustrates a perspective view of the removable agitator in a detached state.
Figure 19:
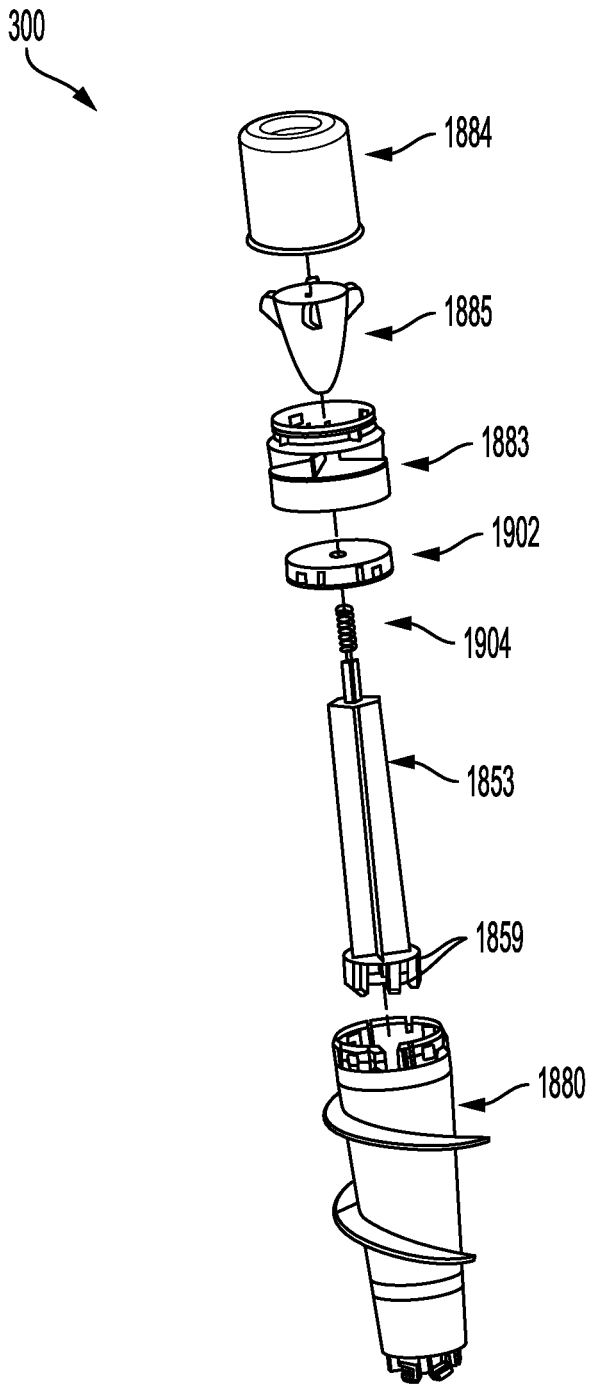
FIG. 19 illustrates an exploded view of the components of the removable agitator.
Figure 21:
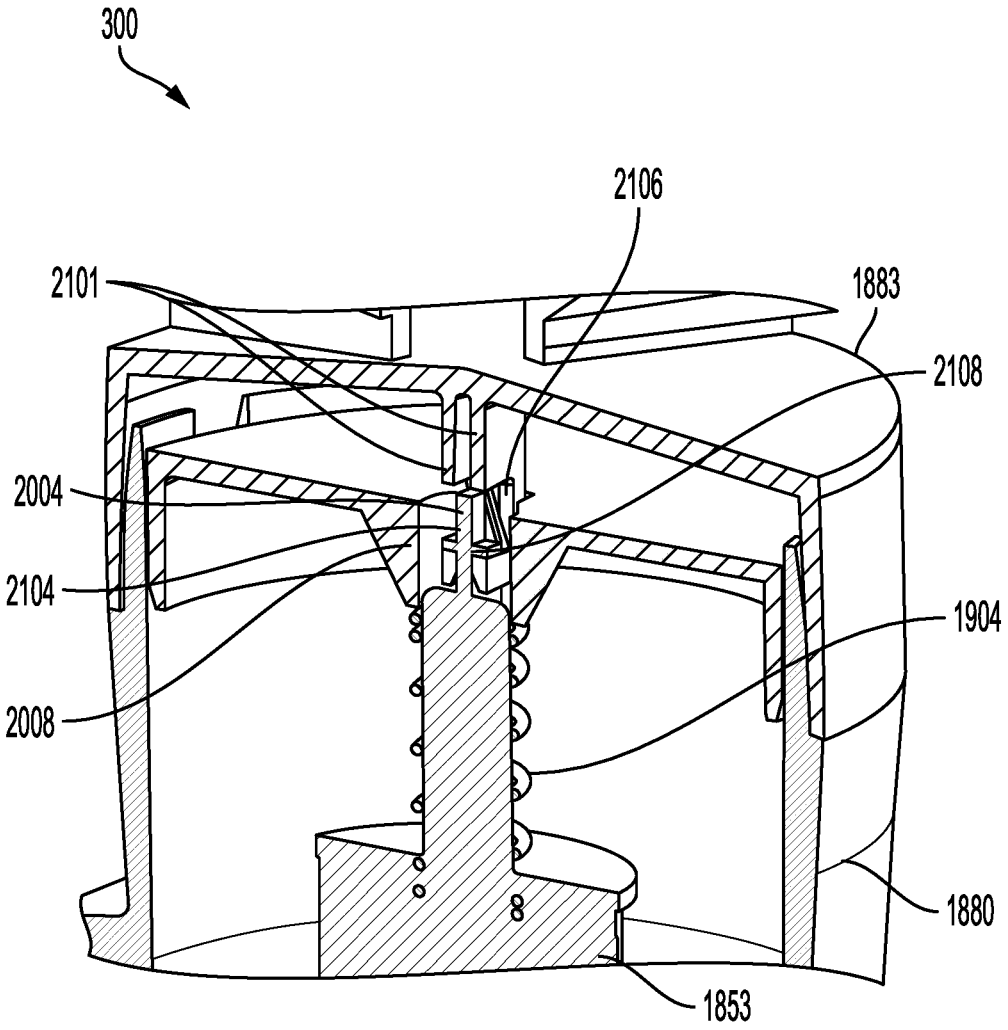
FIG. 21 illustrates a cutaway view of a detail of attachment of the locking post in a lowered, locked position.
Figure 22:
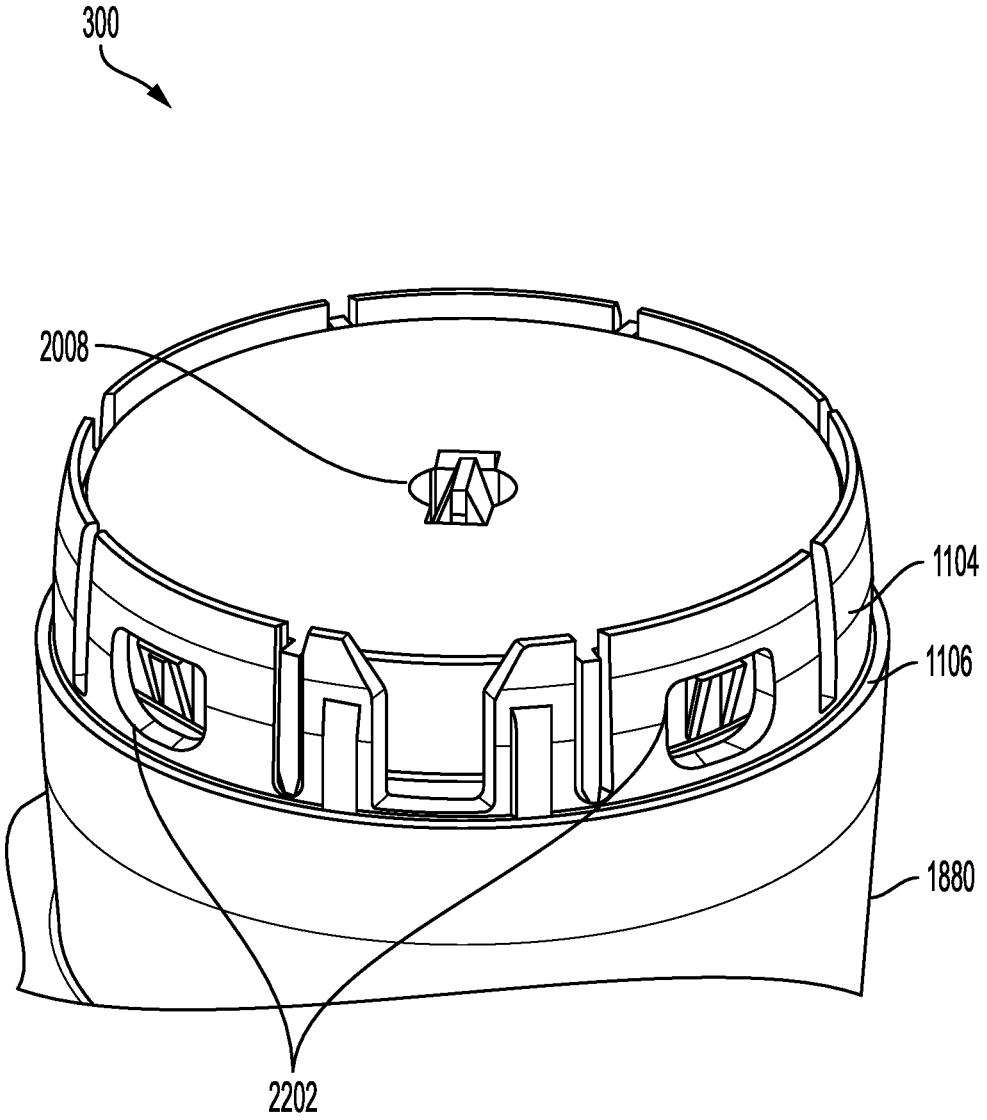
FIG. 22 illustrates a cutaway view of a detail of attachment of the locking post assembled into the agitator barrel.

FIGS. 18-22 collectively illustrate a second embodiment of a removable agitator 1850 having dispensing capabilities. In this example embodiment, the removable agitator utilizes a locking post retainer disc 1902 to maintain the position of a locking post 1853, where a dispenser cap assembly 1882 may be pulled against a biasing mechanism to lock and unlock the removable agitator 1850 from an impeller base 1820. FIG. 18 illustrates a perspective view of the removable agitator 1850 in a detached state. FIG. 19 illustrates an exploded view of the components of the removable agitator 1850. FIG. 20 illustrates a side cutaway view of the removable agitator 1850 showing details of the connection of the locking post 1853 to the dispenser cap base 1883. FIG. 21 illustrates a cutaway perspective view of attachment of the locking post 1853 in a lowered, locked position. FIG. 22 illustrates a perspective view of attachment of the locking post retainer disc 1902 into the agitator barrel 1880.

As shown in FIGS. 18-20, the removable agitator 1850 includes several components similar to the removable agitator 950. For instance, the removable agitator 1850 includes an agitator barrel 1880 and a dispenser cap assembly 1882. The dispenser cap assembly 1882 includes a dispenser cap base 1883, a dispenser cap top 1884, and a dispenser cup 1885. The agitator barrel 1880 similarly includes pins 1856 for attachment to a corresponding impeller 1820, generally corresponding to the attachment of the removable agitator 950 to the impeller 920. The dispenser cup 1885 may fit into a dispenser cup connector 1420, while the dispenser cap top 1884 may snap onto the peripheral wall 1410 of the dispenser cap base 1883, also similar to as discussed above.

A locking post 1853 may be assembled into the agitator barrel 1880, similar to the assembly of the locking post 953 into the agitator barrel 980. The locking post 1853 may include a generally elongate body 1202. The locking post 1853 may define a locking end 1206 having at least one pin 759 protruding downwardly from a lower end of the locking post 953, and may be movable within the removable agitator 950, such that the locking post 953 is vertically slidable within and relative to the removable agitator 950 between a lower, locking position and a raised, unlocked position.

However, instead of a generally cylindrical portion 1204 defined by upper end of the locking post 953, the locking post 1853 instead defines a vertical biasing support member 2002 terminating at a locking post connector 2004 for attachment to a corresponding dispenser base connector 2006 of the dispenser cap base 1883. As best seen in FIG. 21, the dispenser base connector 2006 includes a pair of vertical projections 2102 spaced apart to define a gap through which a center post 2104 of the locking post connector 2004 may snap or otherwise fit. The pair of vertical projections 2102 may further define an open shelf area 2106 through which a lock portion 2108 extending horizontally from the center post 2104 may engage once assembled. It should be noted that this is only one example connector design, and various other snap fit, interference fit, or other connected may be used to allow the locking post 1853 to be pullable upwards by the dispenser cap assembly 1882.

As best seen in FIG. 22, the locking post retainer disc 1902 may define snap connectors to facilitate assembly of the locking post retainer disc 1902 to corresponding snap openings defined by the top of the agitator barrel 1880. When snapped into position, the locking post retainer disc 1902 may be used to retain the upper end of the locking post 1853 vertically within the agitator barrel 1880. The locking post retainer disc 1902 may further define a vertical through opening 2008 providing a path in which the connector 2004 and connector 2006 may vertically move.

A biasing element, illustrated herein as a spring 1904 that extends around the biasing support member 2002, may be assembled between locking post 1853 and the lower surface of the locking post retainer disc 1902 to bias the locking post 1853 downward in the lower, locked position. Thus, the 1902 may also be used to retain the spring 1904 in position.

To move the locking post 1853 into the raised, unlocked position, as shown by arrow 1890, upward movement of the dispenser cap assembly 1882 may be applied to the dispenser cap assembly 1882 to overcome the bias of the spring 1904 against the locking post retainer disc 1902 to accordingly cause the vertical projections 2102 to pull upward on the lock portion 2108, thereby lifting the locking post 1853 into the upper, unlocked position. Once lifted, as shown by arrow 1891, rotational movement of the removable agitator 1850 may allow the removable agitator 1850 to be removed from the impellers 1820.

Thus, the dispenser cap assembly 1882 may be pulled upward away from the agitator barrel 1880 to lift the locking post 1853 from the lower, locked position into the upper, unlocked position. When released, the dispenser cap assembly 1882 may be drawn back into the lower, locked position due to the bias element.

To assemble the removable agitator 1850 into the impeller 1820, the dispenser cap assembly 1882 may be pulled upward away from the agitator barrel 1880 to raise the pins 1859. Then, the removable agitator 1850 may be aligned with the impeller 1820 such that the at least one pin 1856 is aligned with at least one opening 334 of the channels 332, similar to as shown in FIG. 4. The removable agitator 950 may be moved toward the impeller 1820 to insert the least one pin 1856 of the first connector 352 into the second connector 322. As the first connector 352 is inserted into the second connector 322, the pins 1856 travel into the channel 332. The removable agitator 1850 in its entirety may then be rotated with respect to the impeller 1820 to move the pins 1856 into a lock portion 336 of the channel 332. In one example, the at least one locking opening 337 can be positioned beneath the lock portion 336 of the channel 332.

The dispenser cap assembly 1882 may then be released, allowing the locking post 953 to return from the raised position in which the pins 959 do not protruding downwardly between the pins 356 back into the lowered position where the pins 959 are moved downwardly to be inserted into and received within the locking openings 337, to move the pins 1856 into a lock portion 336 of the channel 332. When the pins 359 are received within the locking openings 337, unintended rotation of the removable agitator 1850 relative to the impeller 1820 during a cycle of operation is inhibited. Further, the engagement between the pins 1856 and the lock portion 336 prevents unintended vertical movement of the removable agitator 1850 relative to the impeller 1820.

To disassemble the removable agitator 1850 from the impeller 1820, the dispenser cap assembly 1882 may again be pulled upward, the agitator barrel 1880 rotated, and then the removable agitator 1850 may be pulled upward to be freed form the impeller 1820.

Thus, a 2-in-1 removable agitator that implements an integrated fabric softener dispenser is described. In one example, the removable agitator utilizes a rotatable dispenser cap to control a barrel slot and lock post pin mechanism to facilitate locking and unlocking of the removable agitator from an impeller base. In another example, the removable agitator utilizes a lock post retainer disc to maintain a lock post position, where the dispenser cap may be pulled against a biasing mechanism to lock and unlock agitator barrel to the impeller base.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While the aspects of the present disclosure have been specifically described in connection with certain specific details thereof, it is to be understood that this is by way of illustration and not of limitation. Reasonable variation and modification are possible within the scope of the forgoing disclosure and drawings without departing from the spirit of the present disclosure, which is defined in the appended claims. Hence, specific dimensions and other physical characteristics relating to the aspects of the present disclosure are not to be considered as limiting, unless expressly stated otherwise.

What is claimed is:

1. An agitator configured to be removably mounted to an impeller mount as a clothes mover, the agitator comprising:

an agitator barrel defining a longitudinal axis between a top end and an opposing bottom end of the agitator barrel;

a locking post disposed within the agitator barrel, the locking post having a top end and an opposing bottom end, wherein the locking post is slidable between a lower, locked position securing the agitator barrel to the impeller mount and a raised, unlocked position allowing movement of the agitator barrel with respect to the impeller mount;

a connector disposed at the bottom end of the locking post, the connector being configured to removably attach to a corresponding connector of the impeller mount;

a biasing element configured to bias the locking post into the lower, locked position; and a dispenser cap assembly mounted to the top end of the agitator barrel, the dispenser cap assembly configured to hold a dispenser cup and to control a lock from the top end of the post, the top end of the locking post being assembled to the bottom of the dispenser cap assembly, the dispenser cap assembly facilitating pulling of the locking post upwards against the biasing element to slide the locking post from the lower, locked position into the raised, unlocked position, wherein the lock is configured to be adjusted between the lower, locked position in which the agitator is secured to the impeller mount and the raised, unlocked position allowing movement of the agitator with respect to the impeller mount.

2. The agitator of claim 1, wherein the lock defines at least one locking pin, such that when in the locked position, the at least one locking pin protrudes from the agitator barrel to inhibit movement of the agitator barrel within the impeller mount, and when in the unlocked position, the at least one locking pin is raised to allow for movement of the agitator barrel within the impeller mount.

3. The agitator of claim 1, wherein the locking post defines one or more radial pins extending radially outward from the top end of the locking post, and the dispenser cap assembly defines one or more angled pin tracks each defining a locked end and continuing to an angled portion extending upwards along an interior peripheral wall of the dispenser cap assembly, the angled pin tracks configured to guide vertical movement of the lock between the locked position and the unlocked position due to rotation of the dispenser cap assembly about the longitudinal axis.

4. The agitator of claim 3, wherein the top end of the agitator barrel defines at least one L-shaped channel including a vertical portion extending downward from the top end of the agitator barrel and a horizontal portion extending laterally parallel to the top of the agitator barrel, the at least one L-shaped channel configured to receive corresponding radial pins of the locking post.

5. The agitator of claim 4, wherein:

rotation of the dispenser cap assembly in a first direction about the longitudinal axis with respect to the agitator barrel causes the locked end of the one or more pin tracks to pull the one or more radial pins into the horizontal portion of the respective L-shaped channel, thereby vertically moving the locking post into the lower, locked position, and rotation of the dispenser cap assembly in a second, opposite direction about the longitudinal axis with respect to the agitator barrel causes the angled portion of the pin tracks to push the one or more radial pins into and then upwards along the vertical portion of the respective L-shaped channel, thereby vertically moving the locking post into the raised, unlocked position.

6. The agitator of claim 1, further comprising:

a locking post retainer disc assembled to the top end of the agitator barrel, the locking post retainer disc defining a vertical through opening providing a path in which connection of the dispenser cap assembly to the locking post may vertically move, wherein the biasing element extends around a biasing support member at the top end of the locking post to bias the locking post downward in the lower, locked position against a lower surface of the locking post retainer disc.

7. The agitator of claim 1, wherein the dispenser cap assembly comprises a dispenser cap top and a dispenser cap base, wherein an upper peripheral wall of the dispenser cap base defines an annular snap fit onto which the dispenser cap top is connectable.

8. The agitator of claim 7, wherein an outer surface of the upper peripheral wall defines one or more circumferential ridges to hold against an inner surface of the dispenser cap top.

9. The agitator of claim 8, wherein the dispenser cap base further defines a stop defining a lower limit for downward attachment of the dispenser cap top onto the top of the dispenser cap base.

10. The agitator of claim 7, wherein a lower peripheral wall of the dispenser cap base defines an annular snap fit for mounting the dispenser cap base to the top end of the agitator barrel.

11. The agitator of claim 7, wherein the dispenser cap base defines a dispenser cup connector to fix the dispenser cup into position, the dispenser cup connector defining a plurality of tines extending vertically upward from the dispenser cap base to hold the bottom of the dispenser cup.

12. An agitator configured to be removably mounted to an impeller mount as a clothes mover, the agitator comprising:

an agitator barrel defining a longitudinal axis between a top end and an opposing bottom end of the agitator barrel;

a locking post disposed within the agitator barrel, the locking post having a top end and an opposing bottom end;

a connector disposed at the bottom end of the locking post, the connector being configured to removably attach to a corresponding connector of the impeller mount; and a dispenser cap assembly mounted to the top end of the agitator barrel, the dispenser cap assembly configured to hold a dispenser cup and to control a lock from the top end of the post, wherein the lock is configured to be adjusted between a lower, locked position in which the agitator is secured to the impeller mount and a raised, unlocked position allowing movement of the agitator with respect to the impeller mount, and wherein the locking post defines one or more radial pins extending radially outward from the top end of the locking post, and the dispenser cap assembly defines pin tracks defining a locked end and continuing to an angled portion extending upwards along an interior peripheral wall of the dispenser cap assembly, the pin tracks configured to guide vertical movement of the lock between the locked position and the unlocked position due to rotation of the dispenser cap assembly about the longitudinal axis.

13. The agitator of claim 12, wherein the lock defines at least one locking pin, such that when in the locked position, the at least one locking pin protrudes from the agitator barrel to inhibit movement of the agitator barrel within the impeller mount, and when in the unlocked position, the at least one locking pin is raised to allow for movement of the agitator barrel within the impeller mount.

14. The agitator of claim 12, wherein the top end of the agitator barrel defines at least one L-shaped channel including a vertical portion extending downward from the top end of the agitator barrel and a horizontal portion extending laterally parallel to the top of the agitator barrel, the at least one L-shaped channel configured to receive corresponding radial pins of the locking post.

15. The agitator of claim 14, wherein:

rotation of the dispenser cap assembly in a first direction about the longitudinal axis with respect to the agitator barrel causes the locked end of the pin tracks to pull the one or more radial pins into the horizontal portion of the respective L-shaped channel, thereby vertically moving the locking post into the lower, locked position; and rotation of the dispenser cap assembly in a second, opposite direction about the longitudinal axis with respect to the agitator barrel causes the angled portion of the pin tracks to push the one or more radial pins into and then upwards along the vertical portion of the respective L-shaped channel, thereby vertically moving the locking post into the raised, unlocked position.

16. The agitator of claim 12, wherein the dispenser cap assembly comprises a dispenser cap top and a dispenser cap base, wherein an upper peripheral wall of the dispenser cap base defines an annular snap fit onto which the dispenser cap top is connectable.

17. The agitator of claim 16, wherein an outer surface of the upper peripheral wall defines one or more circumferential ridges to hold against an inner surface of the dispenser cap top.

18. The agitator of claim 17, wherein the dispenser cap top further defines a stop defining a lower limit for downward attachment of the dispenser cap top onto the top of the dispenser cap base.

19. The agitator of claim 16, wherein a lower peripheral wall of the dispenser cap base defines an annular snap fit for mounting the dispenser cap base to the top end of the agitator barrel.

20. The agitator of claim 16, wherein the dispenser cap base defines a dispenser cup connector to fix the dispenser cup into position, the dispenser cup connector defining a plurality of tines extending vertically upward from the dispenser cap base to hold the bottom of the dispenser cup.

* * * * *